US005649592A

United States Patent [19]

Nishishita

[11] Patent Number: 5,649,592

[45] Date of Patent: Jul. 22, 1997

[54] LAMINATED HEAT EXCHANGER

[75] Inventor: Kunihiko Nishishita, Konan, Japan

[73] Assignee: Zexel Corporation, Tokyo, Japan

[21] Appl. No.: 548,740

[22] Filed: Oct. 26, 1995

[30] Foreign Application Priority Data

Oct. 27, 1994 [JP] Japan ..... 6-287497
Apr. 20, 1995 [JP] Japan ..... 7-119373

[51] Int. Cl.[6] ..... F28D 1/03

[52] U.S. Cl. ..... 165/153; 165/176

[58] Field of Search ..... 165/153, 176; 62/515

[56] References Cited

U.S. PATENT DOCUMENTS 5,024,269 6/1991 Noguchi et al. ..... 165/153
5,042,577 8/1991 Suzumura ..... 165/153
5,553,664 9/1996 Nishishita et al. ..... 165/153

*Primary Examiner*—Leonard R. Leo
*Attorney, Agent, or Firm*—Wenderoth, Lind & Ponack

[57] ABSTRACT

In order to prevent damage to the tube elements or the communicating pipe due to water collecting in a gap formed between the tube elements and the communicating pipe by defective brazing in a laminated heat exchanger, in which the water thus collected will be frozen and melted repeatedly, a structure that ensures that no water is collected in such a gap is achieved by making either one or both of the indented portions of the two formed plates, which constitute the indented portion of each tube element, not in contact with the communicating pipe.

18 Claims, 27 Drawing Sheets

LAMINATED HEAT EXCHANGER

BACKGROUND OF THE INVENTION

1. Field of the Invention

The present invention relates to a laminated heat exchanger constituted by laminating tube elements and fins alternately over a plurality of levels, which is used, for instance, in the cooling cycle of an air conditioning system for vehicles.

2. Description of the Related Art

This type of laminated heat exchanger, which has been in development by this applicant, is constituted by laminating a plurality of tube elements alternately with fins. Each of these tube elements is provided with a pair of tanks at one end in the direction of the length and the tanks of the laminated tube elements constitute tank groups by communicating with one another as necessary through communicating holes formed in the direction of the lamination. In addition, the pair of tanks formed in each tube element communicate with each other through a U-shaped heat exchanging medium passage formed in the tube element. A communicating pipe for communicating between intake/outlet portions provided at one end of the laminated heat exchanger and one of the tank groups, is provided between a pair of tank groups that are parallel to the direction of the lamination and this communicating pipe allows heat exchanging medium to be induced into specific tanks. Note that each tube element is constituted by bonding two formed plates face-to-face.

The communicating pipe is mounted on the heat exchanger after the heat exchanger core is formed by laminating the tube elements and the fins, by fitting it into a grooved portion that is formed between the tank groups running parallel to the direction of the lamination and then by brazing it along with the heat exchanger core.

To elaborate on the above, as shown in FIG. 30, a tube element 200 is formed by bonding two formed plates 201 face-to-face, with each formed plate 201 having a brazing margin 203 and a flange 202 which is bent toward the unbonded side in order to improve the strength. In addition, each tube element 200 is provided with a pair of tanks 204 and 205 formed at one end, with a grooved portion 208 formed between the pair of tanks 204 and 205 so that the communicating pipe 206 is mounted in the grooved portion 208. This communicating pipe 206 is brazed while in contact with the flange 202 which is positioned around the grooved portion 208. Note that reference number 207 indicates the brazing material.

However, in a laminated heat exchanger that is structured as described above, since the flange 202 is bonded to the communicating pipe 206 as shown in FIG. 31, if a brazing defect occurs, a roughly triangular gap A may result between the flange 202 and the communicating pipe 206.

If water (condensation, water taken in through the intake port or the like) enters this gap A, as indicated with the arrow in FIG. 31, the water tends to be retained within the gap A, since it will not easily evaporate. This water is then likely to freeze and melt repeatedly due to temperature changes in the heat exchanger, which will cause the brazing margins in the tube elements to be damaged due to the expansion and contraction of the water through such freezing and melting. This will result in leakage of heat exchanging medium.

Moreover, there is a potential problem of the tube elements and the communicating pipe becoming corroded by the water retained in the gap A.

SUMMARY OF THE INVENTION

Reflecting the problems discussed above, the object of the present invention is to provide a laminated heat exchanger that features a structure in which water is prevented from collecting between the tube elements and the communicating pipe.

Accordingly, the laminated heat exchanger according to the present invention comprises formed plates, each of which is provided with a pair of distended portions for tank formation (also referred to as distended tank portions) positioned parallel to each other at one end in the direction of the length and provided with connecting holes formed in the direction of the distension, a U-shaped distended portion for passage formation (also referred to as U-shaped distended passage portion) communicating between the pair of distended portions for tank formation, an indented portion formed between the pair of distended portions for tank formation, a brazing margin formed along the edge of the formed plate at a specific width and a flange, provided upright at the edge of the formed plate, in the direction of the distension of the distended portions; tube elements, each of which is constituted by two such formed plates bonded face-to-face, are provided with a pair of tanks each of which is provided with two connecting holes that open in the direction of the lamination, a U-shaped heat exchanging medium passage communicating between the pair of tanks and an indented portion formed between the pair of tanks, face-to-face; a plurality of tank groups that communicate in the direction of the lamination via the connecting holes, constituted of tanks that lie contiguous; a mounting groove constituted of the indented portions that lie contiguous when a plurality of tube elements are laminated together; a tube element at a specific position that is provided with a communicating portion extending out from one tank toward the indented portion and a first insertion hole; a tube element positioned at approximately the center in the direction of the lamination with one of the communicating holes that open in the direction of the lamination in one tank being blocked off; a plurality of fins provided alternately between the laminated tube elements; a first end plate provided at one end of the laminated tube elements; a second end plate provided at the other end of the laminated tube elements, which is provided with a communicating hole that communicates with one of the tanks of the adjacent tube element and a second insertion hole; an intake/outlet plate secured on to the second end plate, which is provided with intake/outlet portions that communicate with the communicating hole and the second insertion hole; a communicating pipe provided inside the mounting groove to connect the first insertion hole of the communicating portion and the second insertion hole formed in the second end plate. In this laminated heat exchanger, means for non-contact is provided in at least one of the indented portions of the formed plates that will constitute the indented portion of each tube element, a plurality of which will, in turn, constitute the mounting groove, to ensure that the indented portion of the formed plate does not come in contact with the communicating pipe.

As a result, according to the present invention, since the communicating pipe does not come in contact with either or both of the indented portions of the two formed plates that constitute the indented portion of the tube element, no gap is formed between the indented portion of the tube element and the communicating pipe where water could collect. Thus, no water is retained and the water that does adhere becomes evaporated, and the object described above is achieved.

In addition, when neither of the indented portions comes in contact with the communicating pipe, there is no area between the indented portion of the tube element and the communicating pipe where water can adhere and the object described earlier is achieved. Specifically, the means for non-contact may be achieved by setting the width of the indented portions larger than the diameter of the communicating pipe. In this example, since there is a clearance between the communicating pipe and the mounting groove, the gap described earlier is not formed and thus, any problems caused by water collecting in the gap are avoided. However, since the communicating pipe and the mounting groove are not brazed in contact with each other, the holding strength of the communicating pipe may not be sufficient. In order to solve this problem, a holding portion that extends out from one of either the first and second insertion hole or from the circumferential edge of either insertion hole into which the two ends of the communicating pipe are fitted, is formed. With this, the communicating pipe is held with sufficient strength even though it is not fixed in the mounting groove. Also, the holding portion may be substituted by the indented portion of the tube element which is positioned adjacent to the second end plate or it may be formed in this indented portion.

Furthermore, when one of the indented portions does not come in contact with the communicating pipe, since the other indented portion is brazed in contact with the communicating pipe, any problems resulting from reduced holding strength of the communicating pipe are avoided. In addition, since only one indented portion does not come in contact, the gap formed in the contact area of the communicating pipe and the indented portion of the tube element is exposed to the air, thus promoting evaporation of any water in the area and preventing its adhesion there.

Specifically, the means for non-contact may be achieved by:

removing the flange and the brazing margin over a specific range along the indented portion of the formed plate;

forming the indented portion of one formed plate larger than the indented portion of the other formed plate, which comes in contact with the communicating pipe;

constituting a non-contact area by indenting a portion of the indented portion of one formed plate in the direction of the length of the formed plate;

cutting off the flange in the indented portion of the formed plate at an area other than the non-contact area;

indenting a portion of the indented portion of one formed plate in the direction of the length of the formed plate to form a non contact area and forming the area of the indented portion that is other than the non-contact area large;

cutting off portions of the flange and the brazing margin which are positioned over approximately half of the surrounding portion of the indented portion of the formed plate along the indented portion;

forming approximately half of the surrounding area of the indented portions of the formed plate large;

providing a non-contact area by indenting a portion of the indented portion of one formed plate in the direction of the length of the formed plate, and cutting off portions of the flange and the brazing margin over approximately half of the area of the indented portion that is other than the non-contact area;

providing a non-contact area by indenting a portion of the indented portion of one formed plate in the direction of the length of the formed plate, and forming approximately half of the area of the indented portion which is other than the non-contact area large;

providing a non-contact area by indenting a portion of the indented portion of one formed plate in the direction of the length of the formed plate, and cutting off portions of the flange and the brazing margin over approximately half of the area of the indented portion that is other than the non-contact area; and providing a non-contact area by indenting a portion of the indented portion of one formed plate in the direction of the length of the formed plate and forming approximately half of the area of the indented portion which is other than the non-contact area large.

These means ensure that one of the indented portions that constitute the indented portion of a tube element does not come in contact with the communicating pipe, while the other indented portion holds the communicating pipe by being in contact with it, solving the problems discussed earlier.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of preferred embodiments of the present invention in reference to the drawings.

Figure 1A:
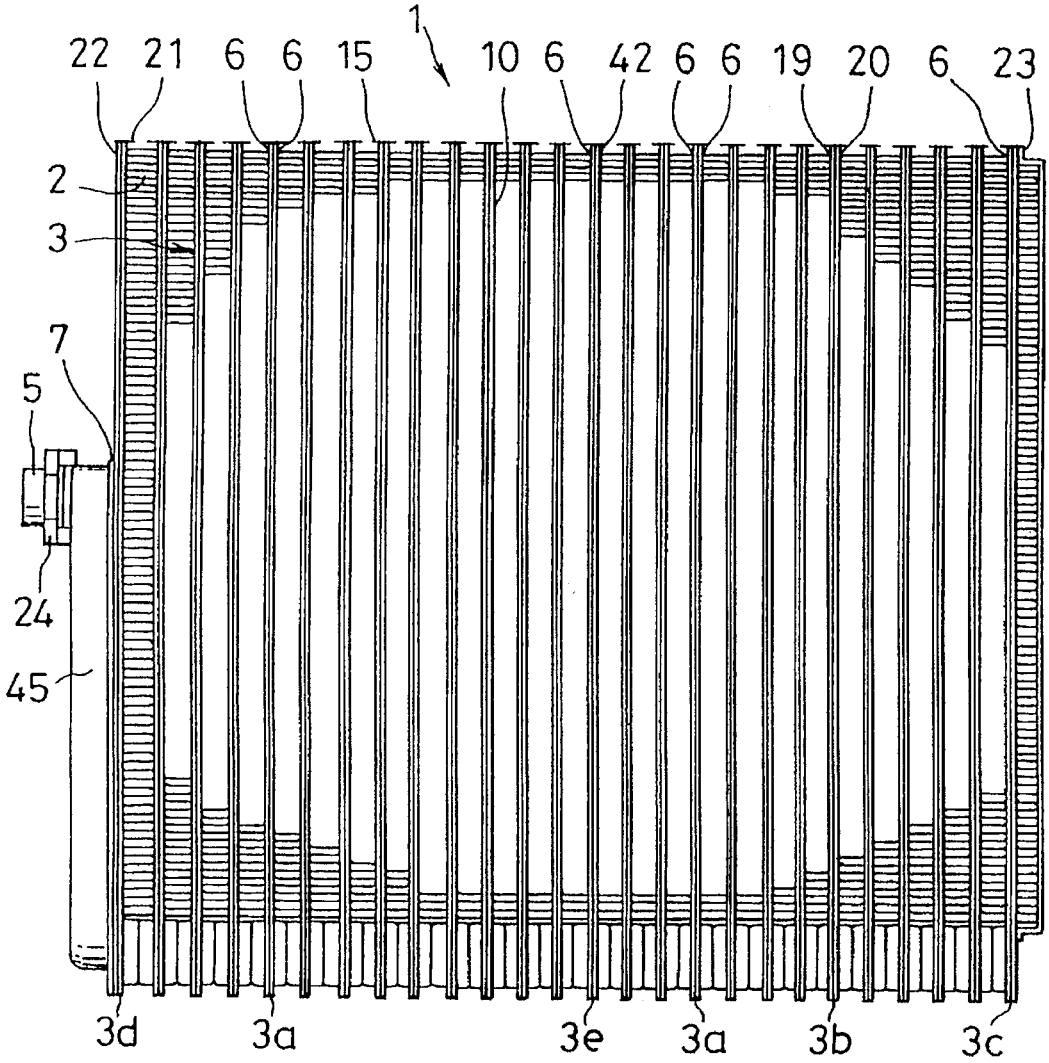
FIG. 1A is a front view of the overall structure of the laminated heat exchanger according to the present invention and FIG. 1B is its bottom view.
Figure 1B:
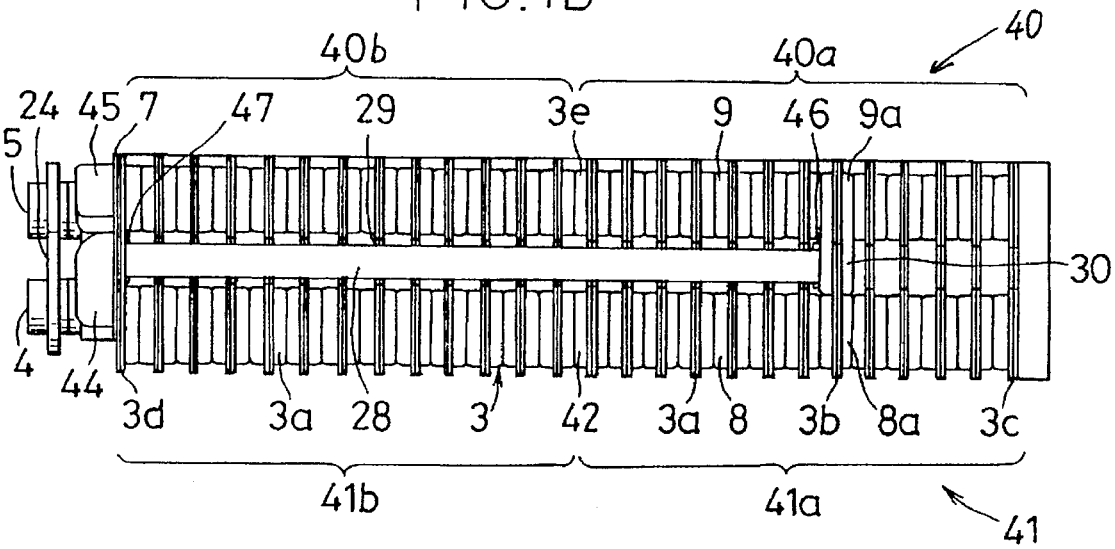

A laminated heat exchanger 1 shown in FIGS. 1A and 1B is a so-called four-pass type evaporator, constituted by laminating fins 2 and tube elements 3 alternately over a plurality of levels and provided with an intake portion 4 and an outlet portion 5 for heat exchanging medium at one side in the direction of the lamination. Note that, structurally, this laminated heat exchanger 1 is constituted with a plurality of types of tube elements (five types in the embodiments presented here) individually assigned reference numbers 3*a*, 3*b*, 3*c*, 3*d* and 3*e*.

Figure 2:
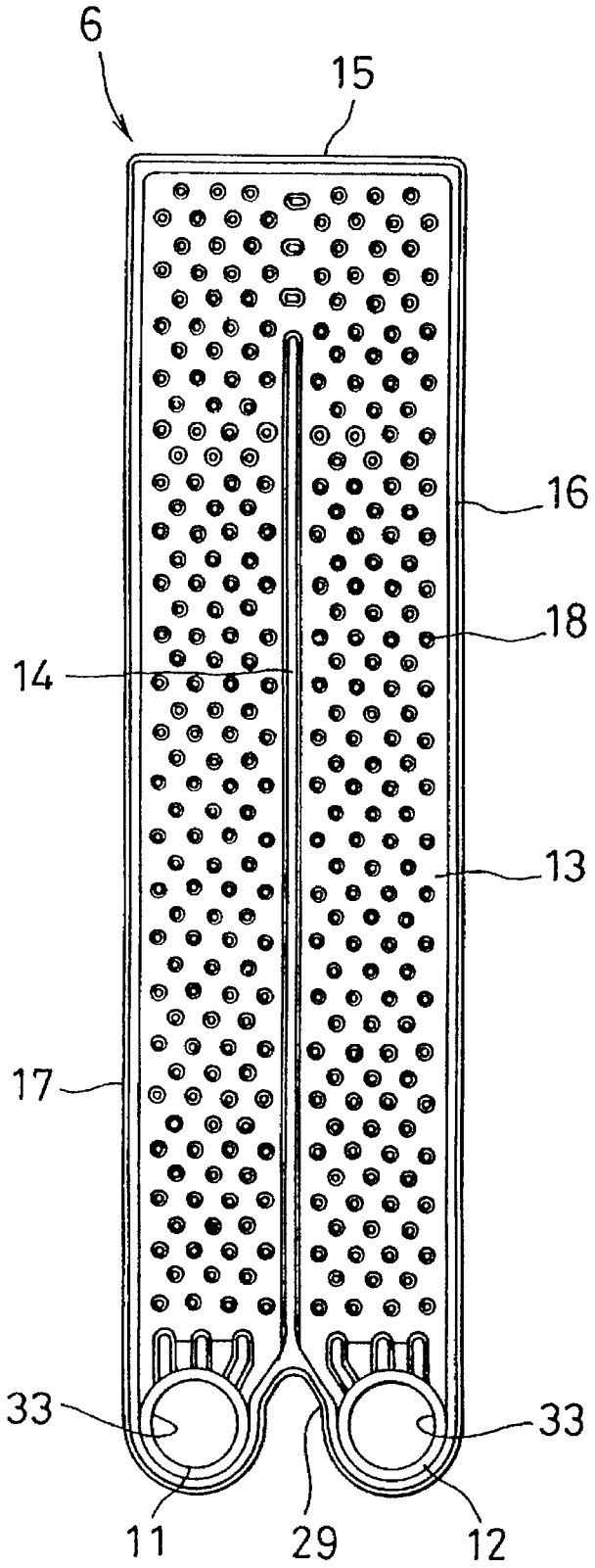
FIG. 2 is a plan view of one of the formed plates which constitute a tube element, viewed from the distension side.

First, a tube element 3*a* is constituted by bonding two formed plates 6 face-to-face, one of which is shown in FIG. 2.

Each formed plate 6 is provided with a pair of distended portions for tank formation (also referred to as distended tank portions); 11 and 12 across an indented portion 29 at one end in the direction of the length. In each of these distended portions for tank formation 11 and 12, a connecting hole 33 opens in the direction of the distension. Also, at the edge of the formed plate 6, a brazing margin 16 is formed over a specific width and a flange 17 is provided upright at the edge of the brazing margin 16 in the direction of the distention of the distended portions for tank formation 14 and 12 over a specific width, in order to improve the strength of the formed plate 6. In addition, a projection 14 extends out from the brazing margin 16 near the apex of the indented portion 29 between the pair of distended portions for tank formation 11 and 12 toward the vicinity of the other end in the direction of the length. A distended portion for heat exchanging medium passage formation (also referred to as distended passage portion) 13, which communicates between the pair of distended portions for tank formation 11 and 12, is formed around the projection 14. Additionally, a plurality of beads 18 are formed in the distended portion for heat exchanging medium passage formation 13 in order to improve the rate of heat exchange. Also, a fin holding portion 15 is formed at the other end of the formed plate 6 in the direction of its length, which projects out to the same side as the flange 17 in order to prevent the fins 2 from coming out during assembly of the heat exchanger.

The tube element 3*a* is constituted by bonding two formed plates 6 structured as described above face-to-face in such a manner that their brazing margins 16, the projections 14 and the beads 18 are in contact. With this, in this tube element 3*a*, a pair of tanks 8 and 9 are formed parallel to each other across the indented portion 29 at one end in the direction of the length, as well as a heat exchanging medium passage 10 that communicates between this pair of tanks 8 and 9. A tube element 3*b* is formed by bonding a formed plate 19 shown in FIG. 3 and a formed plate 20 shown in FIG. 4, face-to-face.

Figure 3:
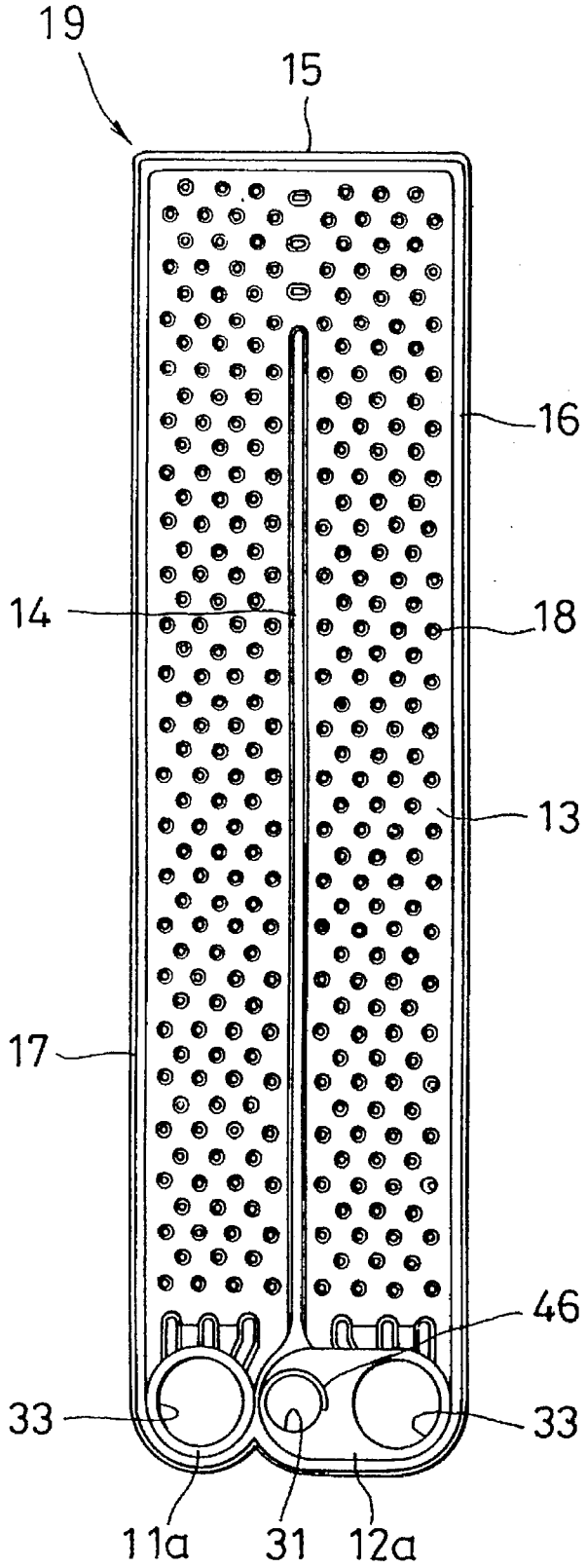
FIG. 3 is a plan view of one of the formed plates which constitute the tube element provided with a communicating portion viewed from the distension side.

In the formed plate 19 shown in FIG. 3, a pair of distended portions for tank formation 11*a* and 12*a* are formed at one end in the direction of its length. One of the distended portions for tank formation, i.e., the distended portion for tank formation 11*a*, is approximately the same size as the distended portion for tank formation 11 in the formed plate 6 described earlier, and is cut off from the other distended portion for tank formation 12*a* by the brazing margin 16. The other distended portion for tank formation 12*a* is shaped elliptically, extending out toward the indented portion 29 and is provided with a connecting hole 33 at the same position as that in the formed plate 6, with a first insertion hole 31, into which a communicating pipe 28 to be detailed below is fitted, formed at a position that faces opposite the position of the indented portion 29. Also, the brazing margin 16 is formed on the edge of the formed plate 19 over a specific width, and a flange 17 is provided upright at the edge of the brazing margin 16 in the direction of the distention of the distended portions for tank formation 11*a* and 12*a* over a specific width, in order to improve the strength of the formed plate 19. In addition, a projection 14 extends out from the brazing margin 16 near the apex at a position that corresponds to the indented portion 29 of the distended portion for tank formation 12*a*, toward the vicinity of the other end in the direction of the length. A distended portion for heat exchanging medium passage formation 13, that communicates between the pair of distended portions for tank formation 11*a* and 12*a*, is formed around the projection 14. Additionally, a plurality of beads 18 are formed in the distended portion for heat exchanging medium passage formation 13 in order to improve the rate of heat exchange. Also, a fin holding portion 15, which projects out to the same side as the flange 17 in order to prevent the fins 2 from coming out during assembly of the heat exchanger, is formed at the other end of the formed plate 19 in the direction of its length.

Figure 4:
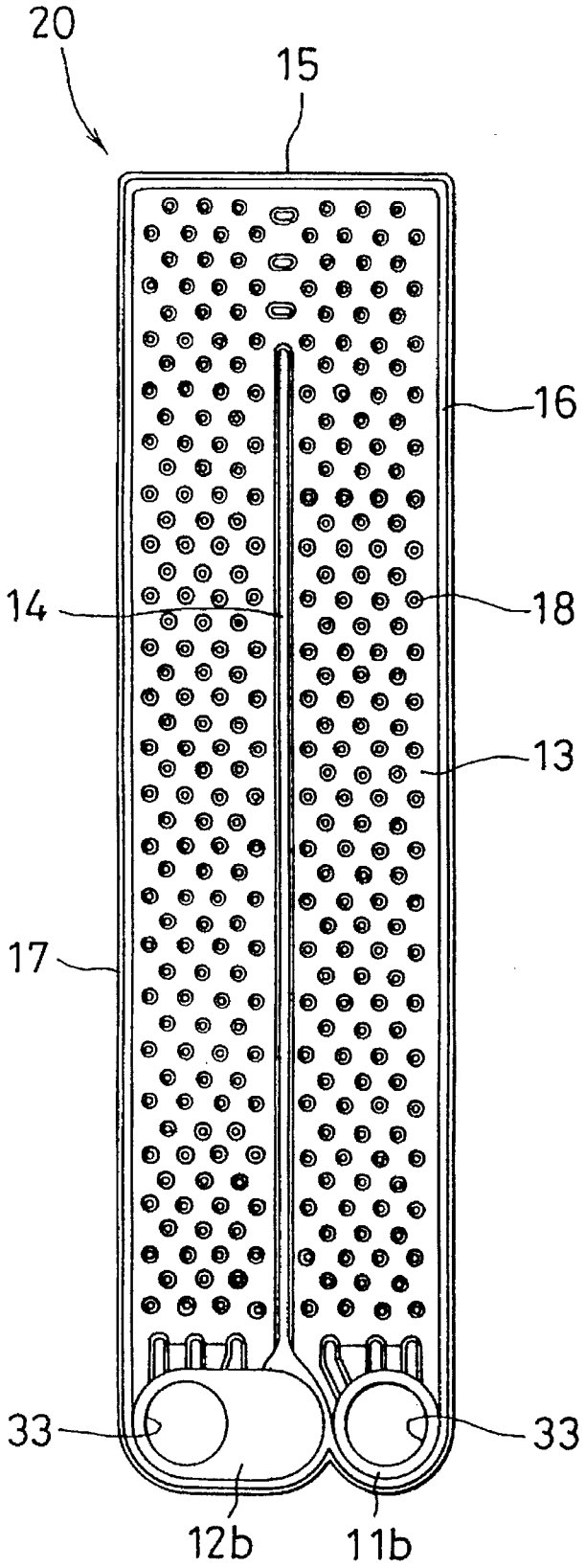
FIG. 4 is a plan view of the other of the formed plates which constitute the tube element provided with a communicating portion viewed from the distension side.

In the formed plate 20 shown in FIG. 4, a pair of distended portions for tank formation 11*b* and 12*b* are formed at one end in the direction of its length. One of the distended portions for tank formation, i.e., the distended portion for tank formation 11*b*, is approximately the same size as the distended portion for tank formation 11 in the formed plate 6 described earlier and is cut off from the other distended portion for tank formation 12*b* over the brazing margin 16. The other distended portion for tank formation 12*b* is shaped elliptically, extends out toward the indented portion 29 and is provided with a connecting hole 33 at the same position as the connecting hole in the formed plate 6. Also, the brazing margin 16 is formed on the edge of the formed plate 20 over a specific width, and a flange 17 is provided upright at the edge of the brazing margin 16 in the direction of the distention of the distended portions for tank formation 11*b* and 12*b* over a specific width, in order to improve the strength of the formed plate 20.

In addition, a projection 14 extends out from the brazing margin 16 near the apex at the position that corresponds to the indented portion 29 of the distended portion for tank formation 12*b* toward the vicinity of the other end in the direction of the length, with a distended portion for heat exchanging medium passage formation 13 that communicates between the pair of distended portions for tank formation 11*b* and 12*b* formed around the projection 14. Additionally, a plurality of beads 18 are formed in the distended portion for heat exchanging medium passage formation 13 in order to improve the rate of heat exchange. Also, a fin holding portion 15 projecting out to the same side as the flange 17 in order to prevent the fins 2 from coming out during assembly of the heat exchanger, is formed at the other end of the formed plate 20 in the direction of its length.

The tube element 3*b* is formed by bonding the formed plates 19 and 20, which are structured as described above, face-to-face. This provides the tube element 3*b* with a tank 9*a* which, in turn, is provided with a communicating pipe 30 and a tank 8*a* that is positioned parallel to the tank 9*a* at one end and heat exchanging medium passage 10 that communicates between the tank 9*a* and the tank 8*a*. This tube element 3*b* is positioned at approximately ¾ of the way from the intake/outlet side.

The tube element 3*c* is formed by blocking off the open side of the formed plate 6 with a flat end plate (a first end plate) and is positioned at the end opposite the intake/outlet side in the laminated heat exchanger.

Figure 5:
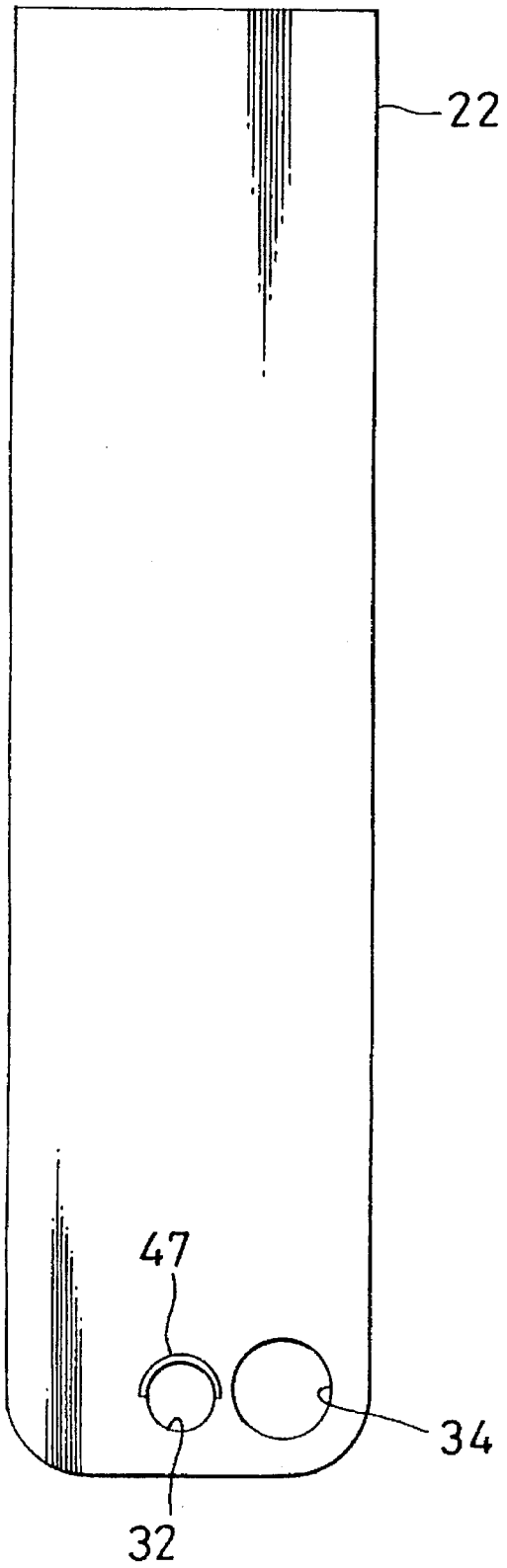
FIG. 5 is a plan view of the second end plate provided with a holding portion.

The tube element 3*d*, which is positioned at the end opposite the tube element 3*c*, is formed by bonding the formed plate 6 and the end plate 22, shown in FIG. 5, face-to-face. In the end plate 22, a through hole 34, which communicates with the connecting hole 33 described earlier, opens and at the lower end, a second insertion hole 32 in which the other end of the communicating pipe 28 is inserted is formed at the center.

Also, a plate for intake/outlet passage formation 7 is secured on to the end plate 22 of this tube element 3*d*. In the plate for intake/outlet passage formation 7, an intake passage 44, which communicates between the second insertion hole 32 and the intake portion 4, and an outlet passage 45, which communicates between the through hole 34 and the outlet portion 5 are formed. A mounting plate 24 for mounting an expansion valve (not shown) is secured on to the intake portion 4 and the outlet portion 5.

The tube element 3*e* is constituted with the formed plate 6 and a formed plate 42 that is identical to the formed plate 6 except that the connecting hole 33 of one of the distended portions for tank formation, i.e., the distended portion for tank formation 11, is blocked off.

With this, when the tube elements 3 are laminated alternately with the fins 2, the tube elements 3*d* and 3*c* are positioned at the two sides, the tube element 3*e* is positioned at approximately the center, the tube element 3*b* is positioned approximately half way between the tube elements 3*e* and 3*c* and the tube elements 3*a* occupy the remaining area.

When the tube elements 3 are laminated, a pair of tank groups 40 and 41, which run parallel to the direction of the lamination are constituted. Of these tank groups, the tank group 40 is separated by the tube element 3*e* into two tank subgroups, 40*a* and 40*b*.

Figure 12:
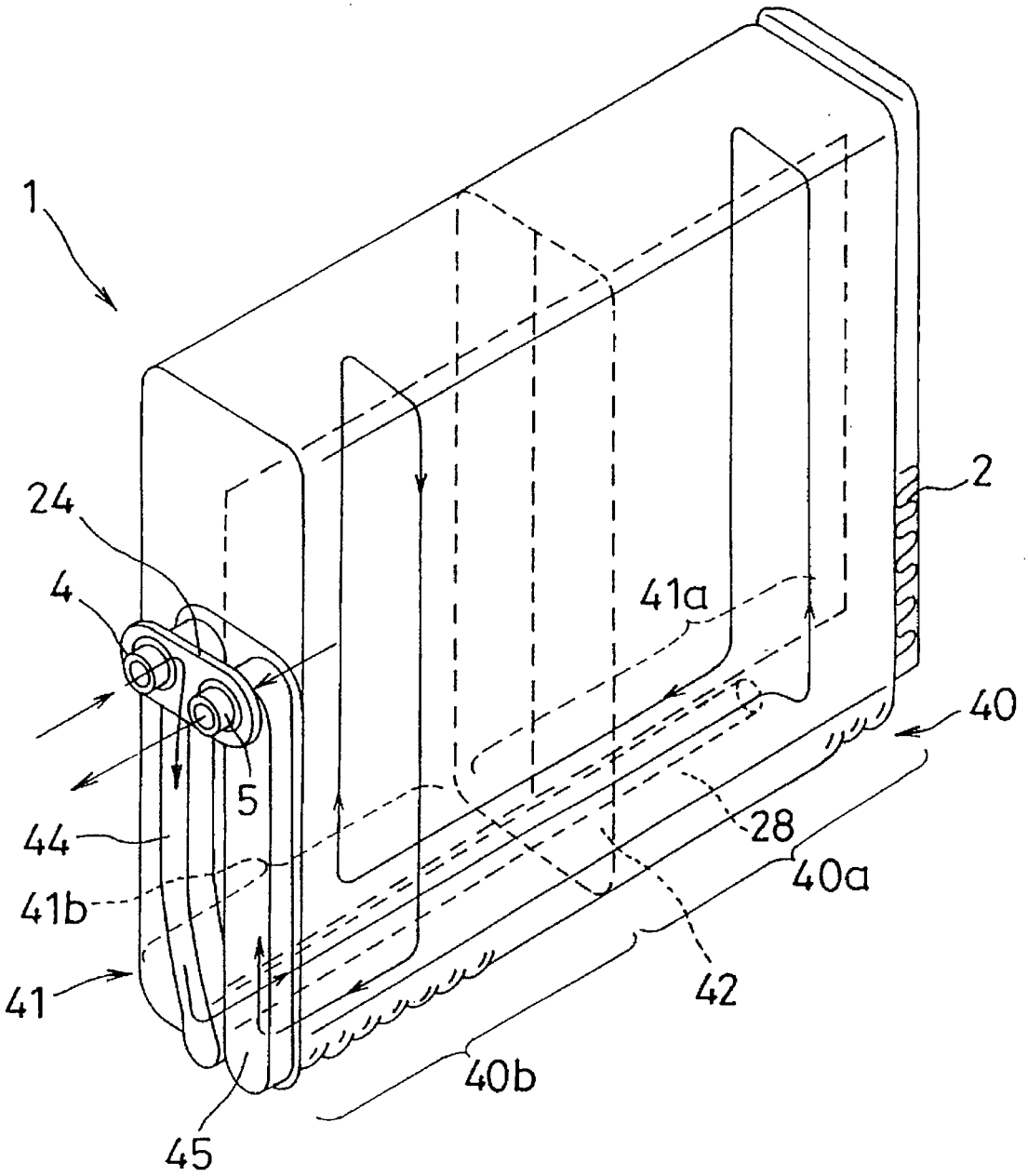
FIG. 12 illustrates the flow of heat exchanging medium in the laminated heat exchanger structured as above.

This allows the heat exchanging medium, for example, a coolant, that has flowed in through the intake portion 4 to pass through the intake passage 44, travel through the communicating pipe 28 from the second insertion hole 32 to reach the tank subgroup 40*a*, as shown in FIG. 12. Once the coolant has reached the tank subgroup 40*a*, it travels through the heat exchanging medium passage 10 that communicates with the tank subgroup 40*a* to reach the tank subgroup 41*a*. After reaching the tank subgroup 41*a*, the coolant moves to the tank subgroup 41*b*, and travels through the heat exchanging medium passage 10 which communicates with the tank subgroup 41*b* to reach the tank subgroup 40*b*. Then the coolant travels through the outlet passage 45 from the tank subgroup 40*b* via the communicating hole 34 to be sent to the next process from the outlet portion 5. This allows the coolant to pass four times relative to the airflow through the laminated heat exchanger 1, constituting a four-pass heat exchanger.

Figure 6:
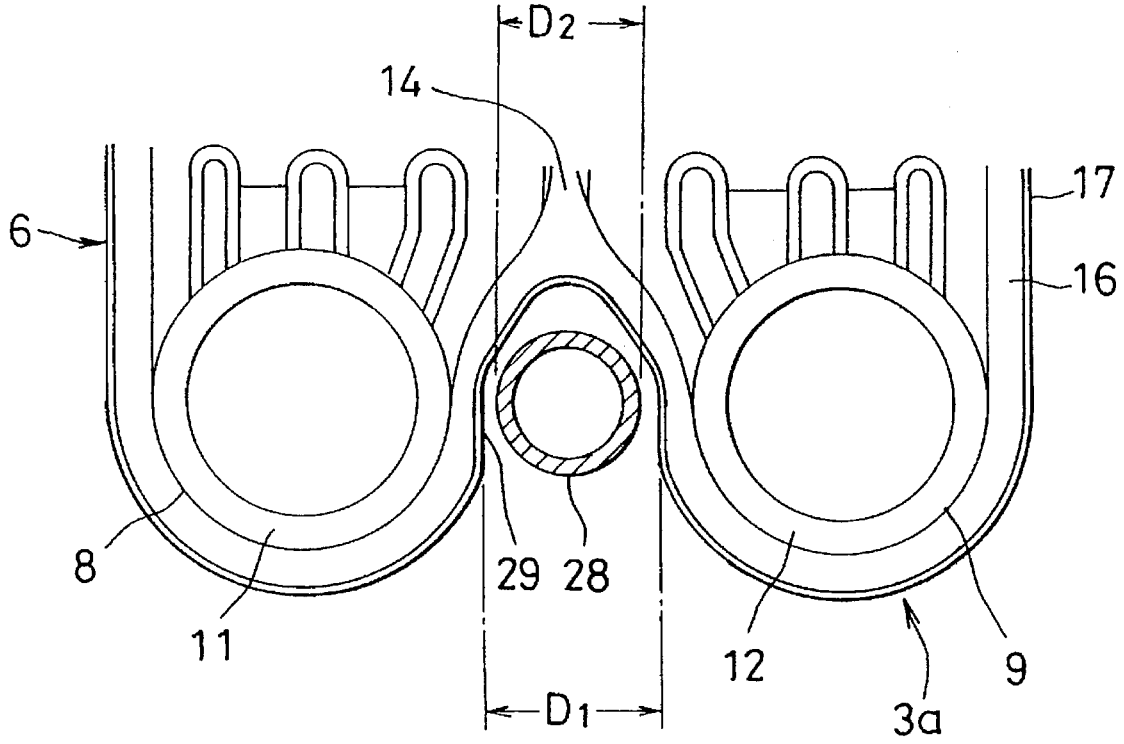
FIG. 6 illustrates the positional relationship between the tube elements and the communicating pipe.

In this laminated heat exchanger 1, the communicating pipe 28 communicates between the first insertion hole 31 formed in the communicating portion 30 of the tube element 3*b* and the second insertion hole 32. In the heat exchanger as shown in FIG. 6, the width D1 of the indented portions 29 of the formed plates 6 constituting the tube elements 3*a* is formed larger than the diameter D2 of the communicating pipe 28 and the communicating pipe 28 is held off the indented portions 29 by a specific distance. The distance between the indented portions 29 and the communicating pipe 28 should be approximately 0.3 mm or more.

Thus, since there is a clearance created between the communicating pipe 28 and the indented portions 29, no gap will be formed between the communicating pipe 28 and the indented portions 29 due to defective brazing and resulting in water collecting in this gap.

Figure 7A:
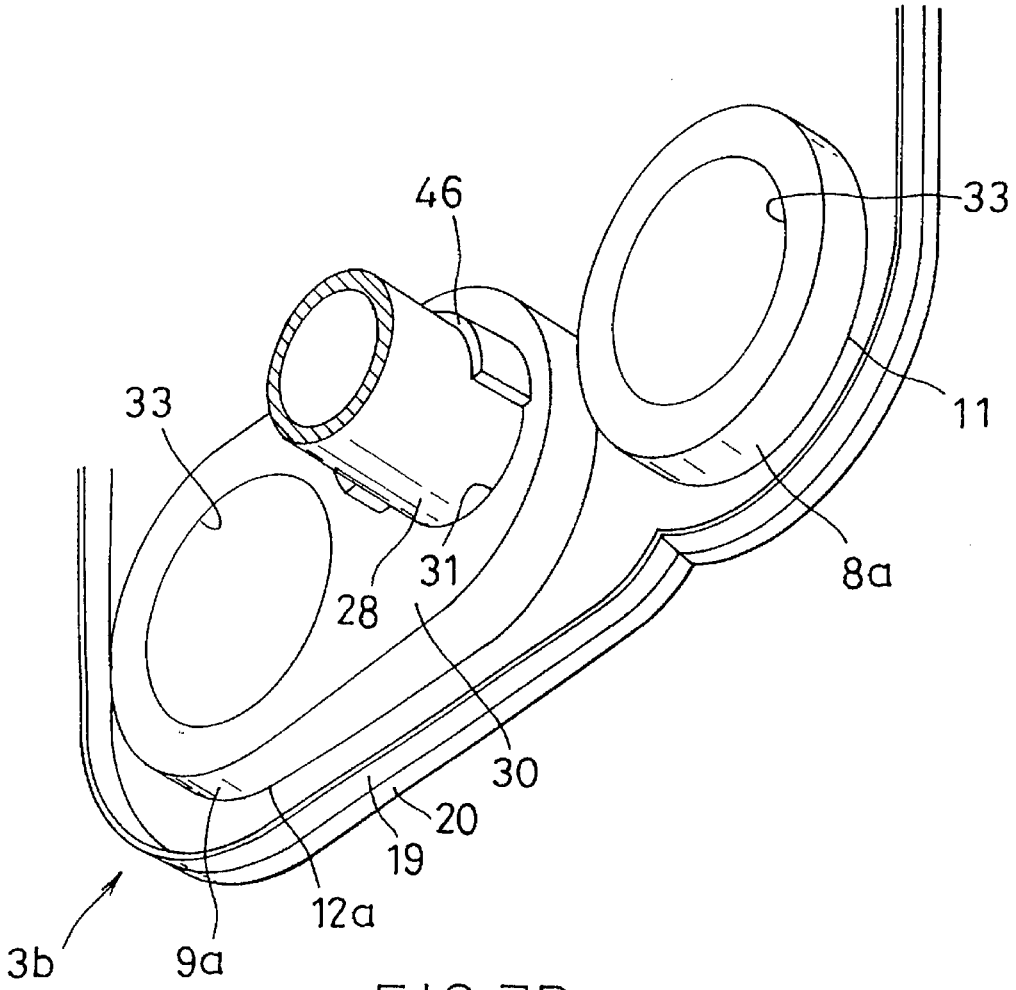
FIG. 7A is a partial perspective of the communicating pipe mounted in the first insertion hole in the communicating portion and FIG. 7B is its partial cross section.
Figure 7B:
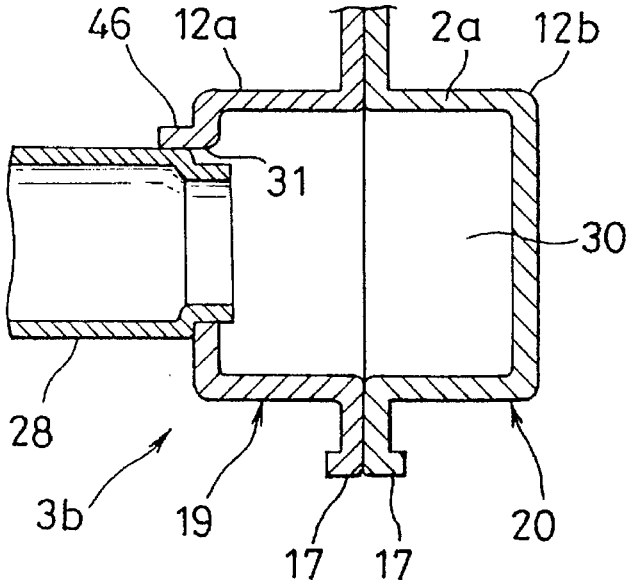

In addition, since the communicating pipe 28 is not brazed while in contact with the indented portions 29, it is expected that the holding strength between the first and the second insertion holes 31 and 32 and the communicating pipe 28 will be insufficient. In order to deal with this, as shown in FIGS. 3, 7A and 7B, a first holding portion 46, which extends out from the circumferential edge of the first insertion hole 31 toward the second insertion hole 32 is formed. This first holding portion 46 is formed semi-circularly along the circumferential edge of the first insertion hole 31 and its internal circumferential surface is made to come in contact with the external circumferential surface of one end of the communicating pipe 28. The communicating pipe 28 and the holding portion 46 are brazed in the state in which the first holding portion 46 supports the communicating pipe 28 when the heat exchanger is placed upside down during brazing, and this contributes to an improvement in the brazing state. Note that while the first holding portion 46 is formed semi-circularly in this particular embodiment, it may be an arc of a specific angle or may have any shape that conforms to the external circumferential surface of the communicating pipe 28, as long as it comes in contact with the external circumferential surface of the communicating pipe 28.

Figure 8A:
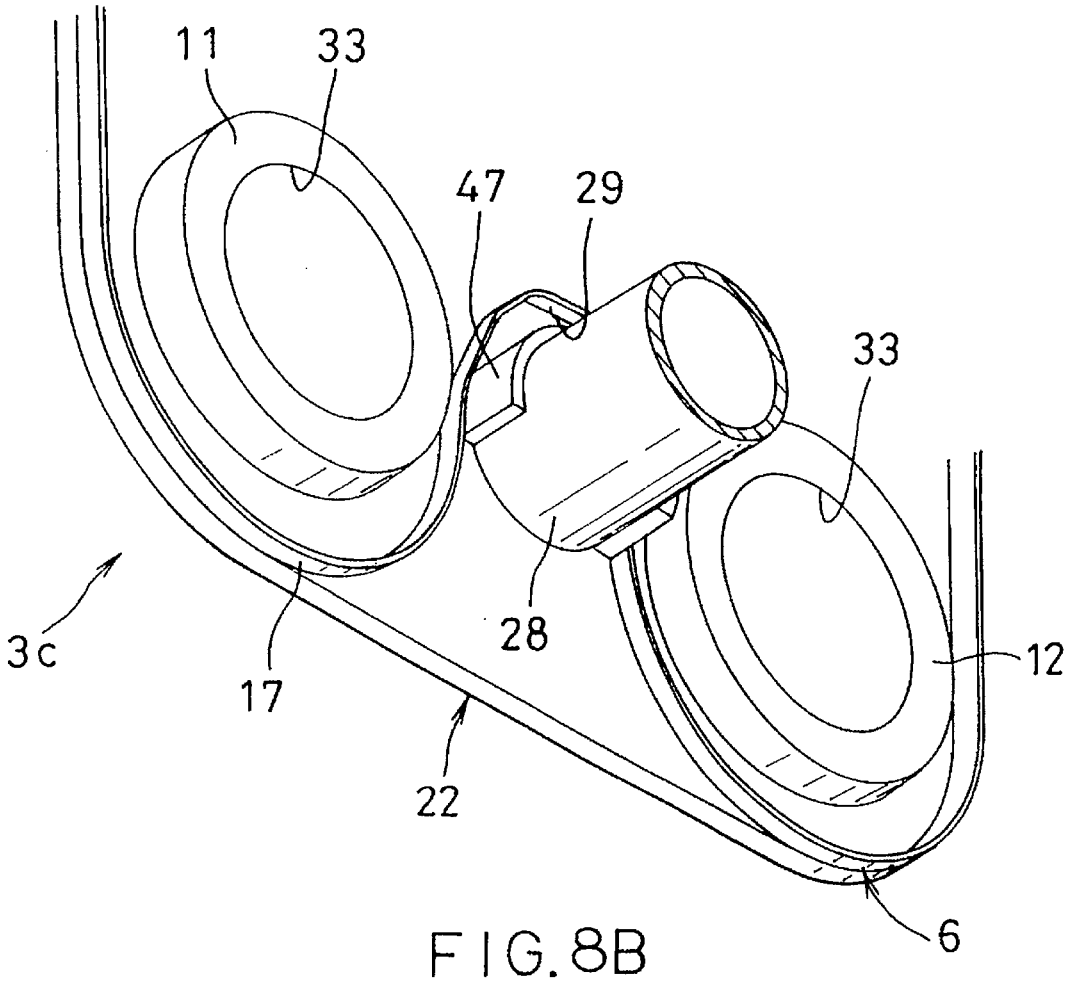
FIG. 8A is a partial perspective of the communicating pipe mounted in the second insertion hole and FIG. 8B is its partial cross section.
Figure 8B:
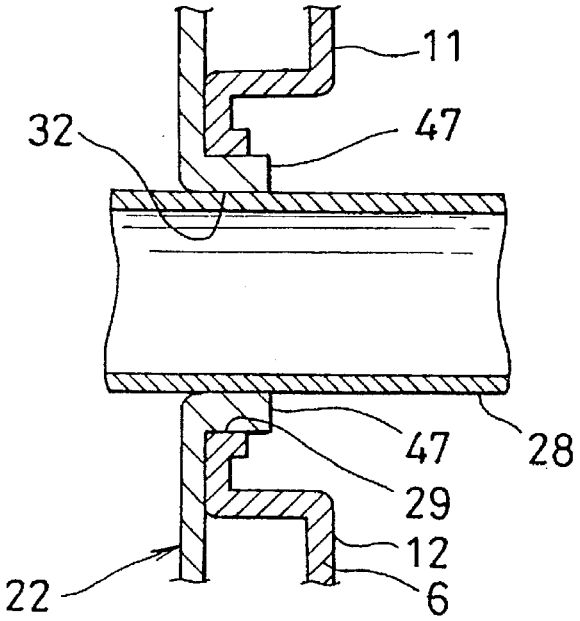

Also, on the second end plate 22 side, as shown in FIGS. 5, 8A and 8B, a second holding portion 47 is formed, which extends out from the circumferential edge of the second insertion hole 32 formed in the second end plate 22 toward the first insertion hole 31. As in the case of the first holding portion 46, this second holding portion 47, too, is brazed in the state in which the second holding portion 47 supports the communicating pipe 28 when the heat exchanger is placed upside down during brazing and this contributes to an improvement in the brazing state. Note that, while the second holding portion 47, too, is formed semi-circularly in this embodiment, it may be an arc of a specific angle or may have any shape that conforms to the external circumferential surface of the communicating pipe 28 as long as it is in contact with the external circumferential surface of the communicating pipe 28. Furthermore, while, in this embodiment, the communicating pipe 28 is held at the two sides, it may be held with a holding portion formed at one side only, as long as sufficient holding strength is ensured.

Figure 9:
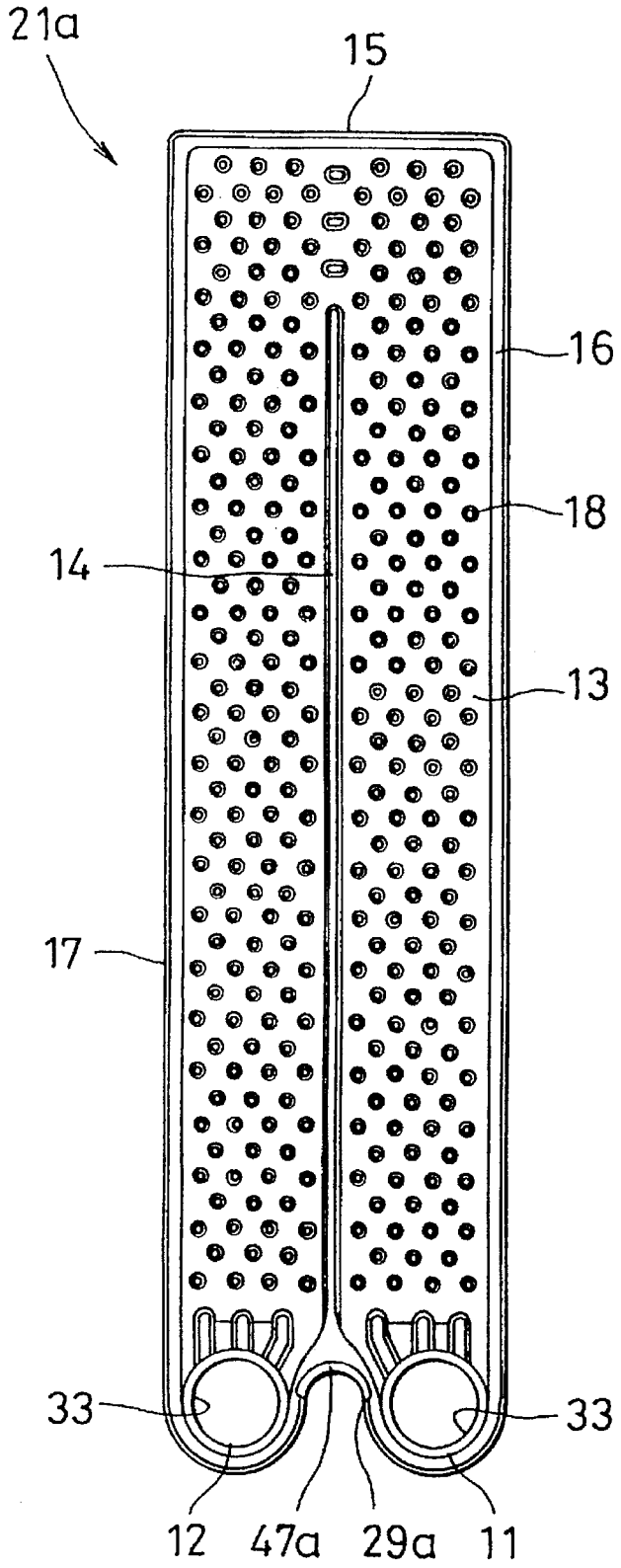
FIG. 9 is a plan view of a formed plate provided with a holding portion.

In the embodiment illustrated in FIG. 9, one end of the communicating pipe 28 is supported by a formed plate 21*a* and the indented portion 29*a* of this formed plate 21*a* is formed to be in contact with the communicating pipe 28. Also, a second holding portion 47*a*, which extends out toward the first holding portion 46 is provided in the indented portion 29*a* and this achieves an improvement in the holding strength between the indented portion 29*a* and the communicating pipe 28. This second holding portion 47*a* is identical to the second holding portion 47 described earlier.

Figure 10:
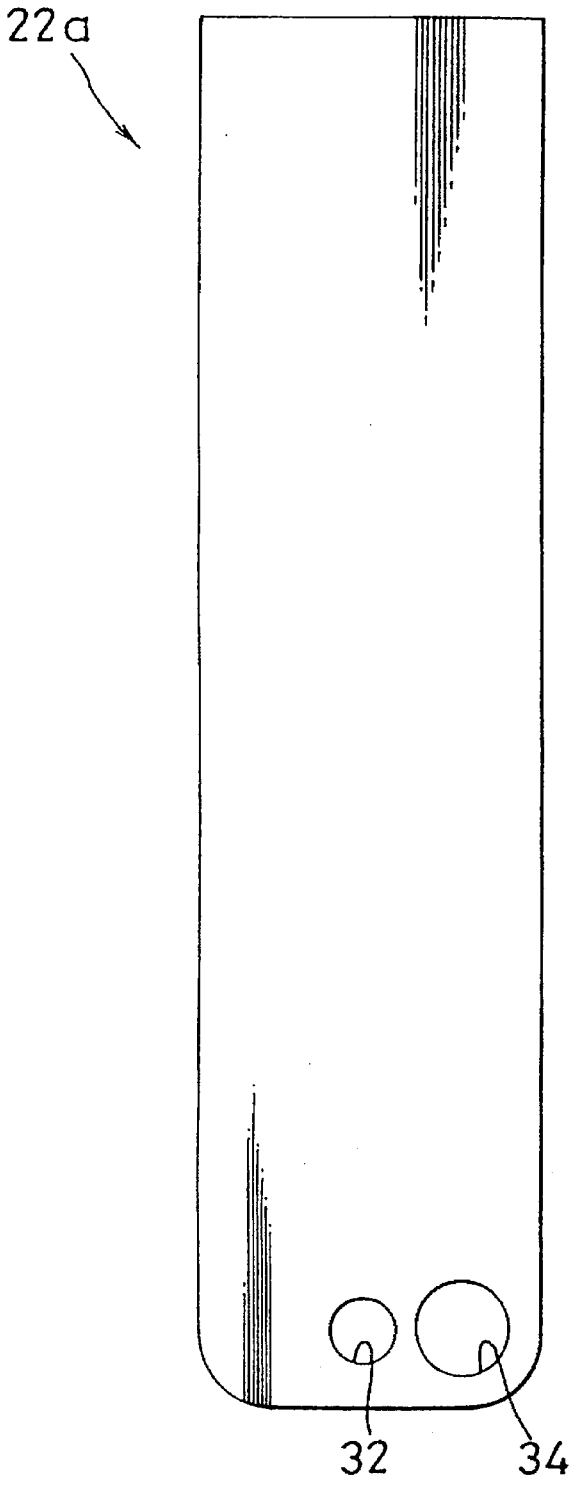
FIG. 10 is a plan view of the end plate, which is to be bonded with the formed plate shown in FIG. 9.
Figure 11A:
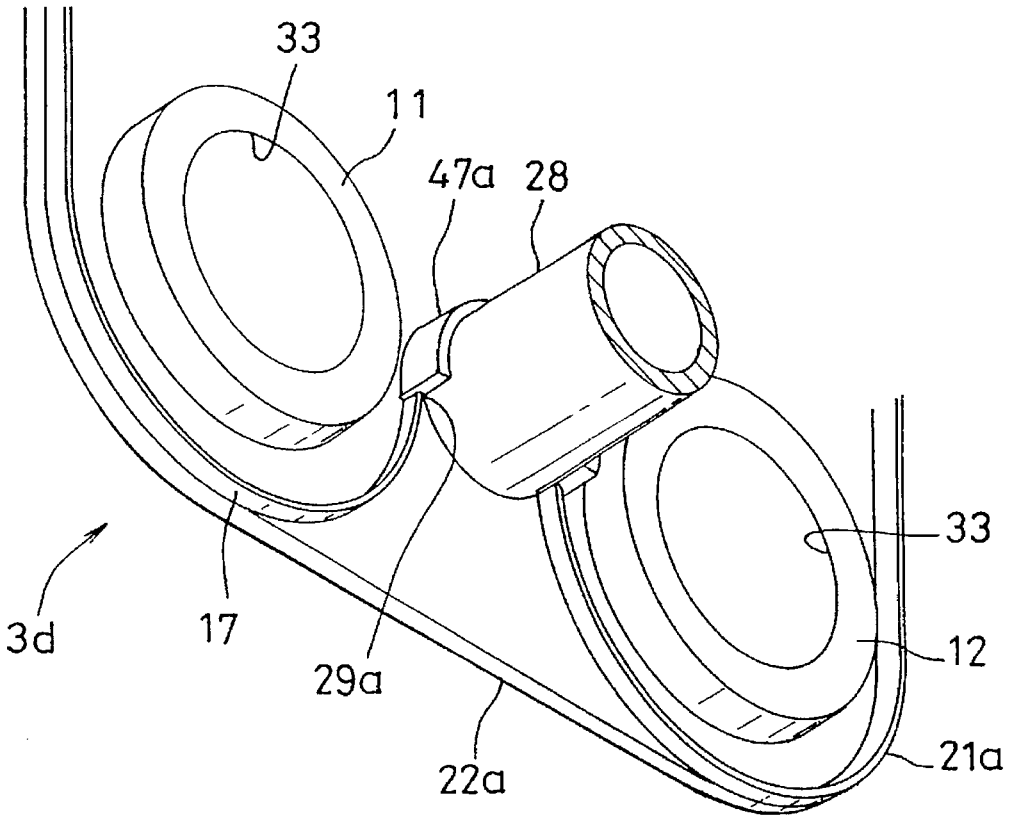
FIG. 11A is a partial perspective of the communicating pipe mounted in the second insertion hole and FIG. 11B is its partial cross section, when the formed plate and the end plate shown in FIGS. 9 and 10 respectively are used.
Figure 11B:
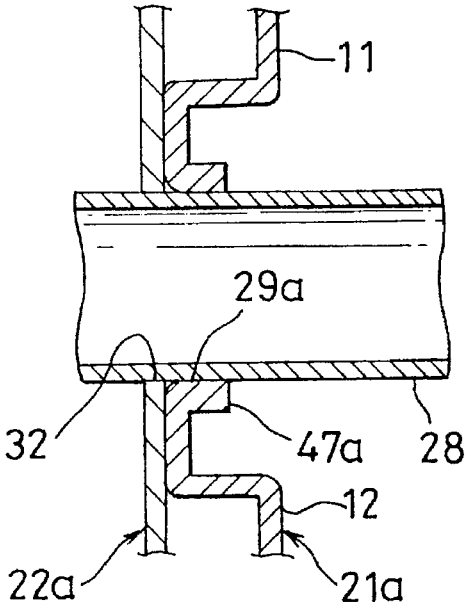

An end plate 22*a*, which is bonded to the formed plate 21*a* to constitute the tube element 3*d*, is provided with a second insertion hole 32 and a communicating hole 34 as is the end plate 22 described earlier, as shown in FIG. 10.

With this, since one end of the communicating pipe 28 is brazed while positioned in the indented portion 29*a* of the formed plate 22*a* and on the second holding portion 47*a* which extends out from the indented portion 29*a* while the heat exchanger is positioned upside down for brazing, the bonding areas of the communicating pipe 28 and the indented portion 29*a* of the formed plate 22*a* and the communicating pipe 28 and the second holding portion 47*a* are brazed thoroughly, achieving sufficient holding strength without bonding the communicating pipe 29 to the tube elements 3*a* in an area other than at the two ends of the communicating pipe 28.

Following is an explanation of another embodiment of the present invention.

Figure 13:
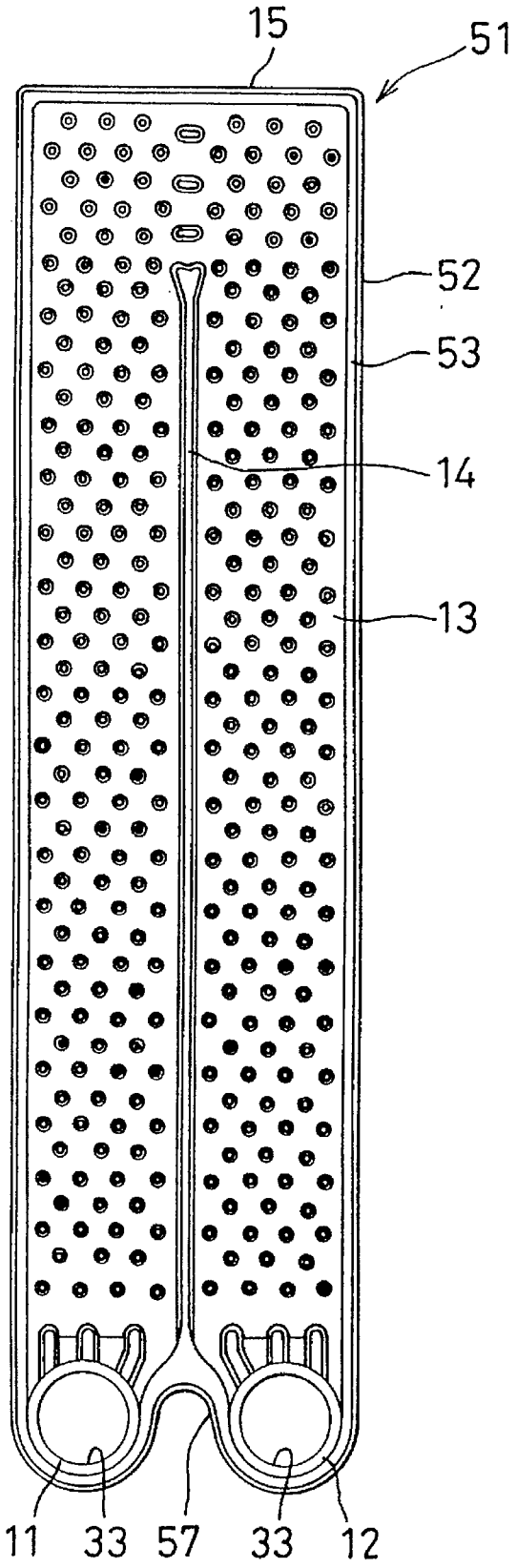
FIG. 13 illustrates a formed plate provided with an indented portion which comes in contact with the communicating pipe.
Figure 14:
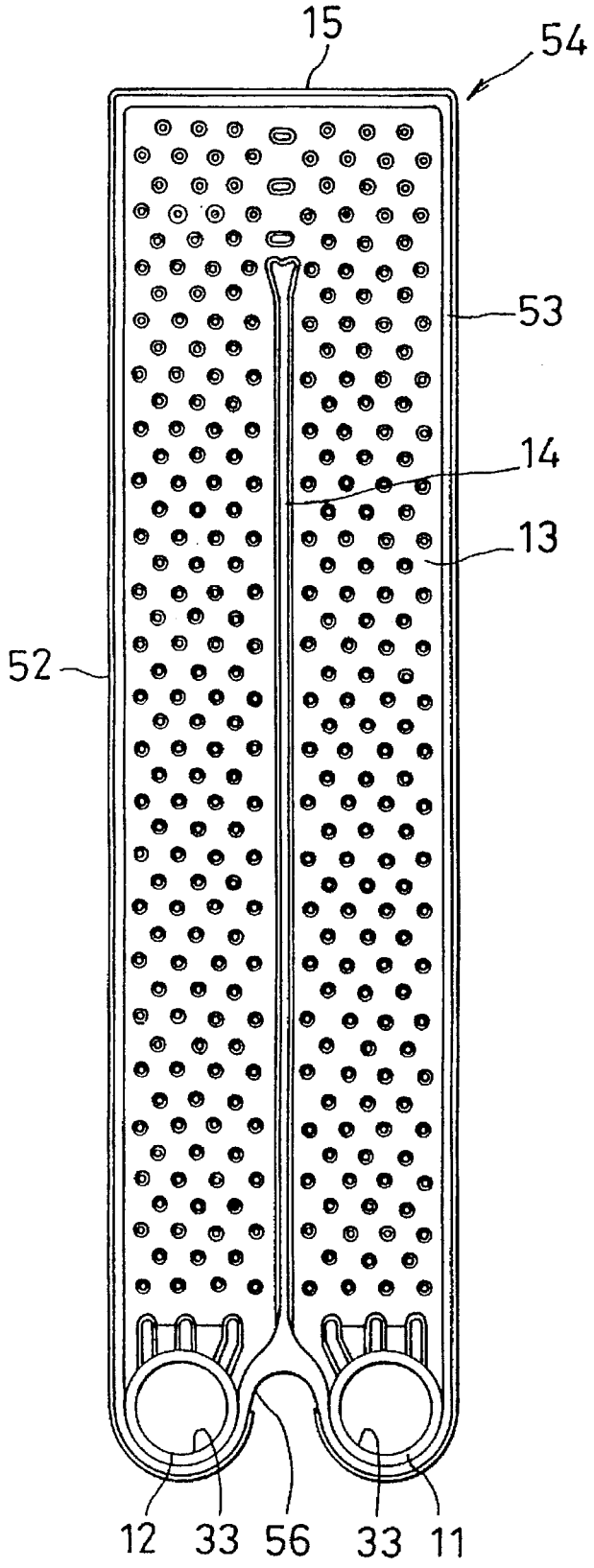
FIG. 14 illustrates a formed plate provided with a first means for non-contact.
Figure 15A:
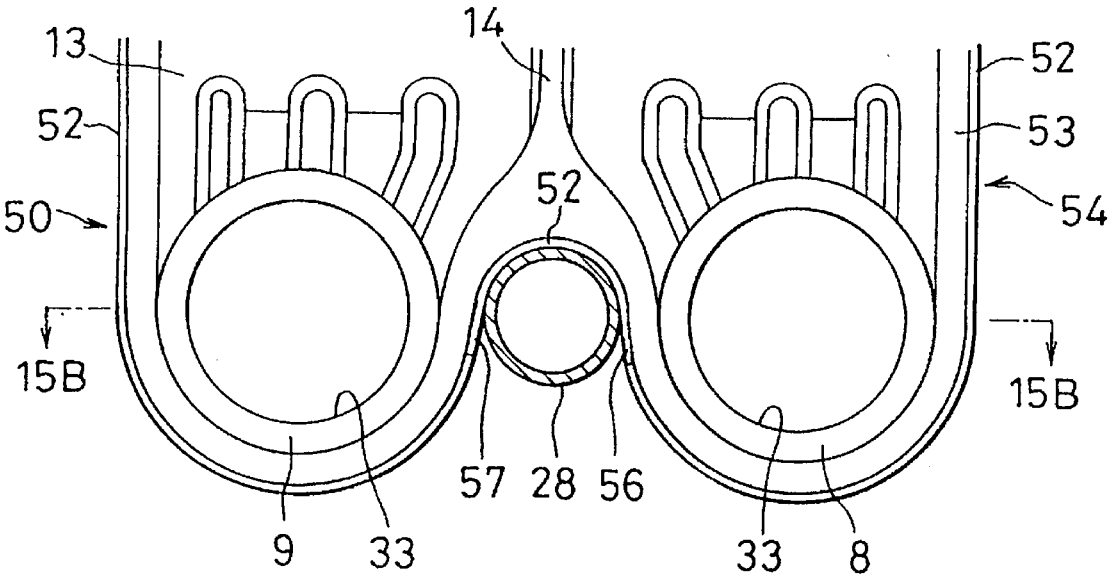
FIG. 15A illustrates the state of contact between a tube element constituted by bonding face-to-face the formed plates shown in FIGS. 13 and 14, and the communicating pipe
Figure 15B:
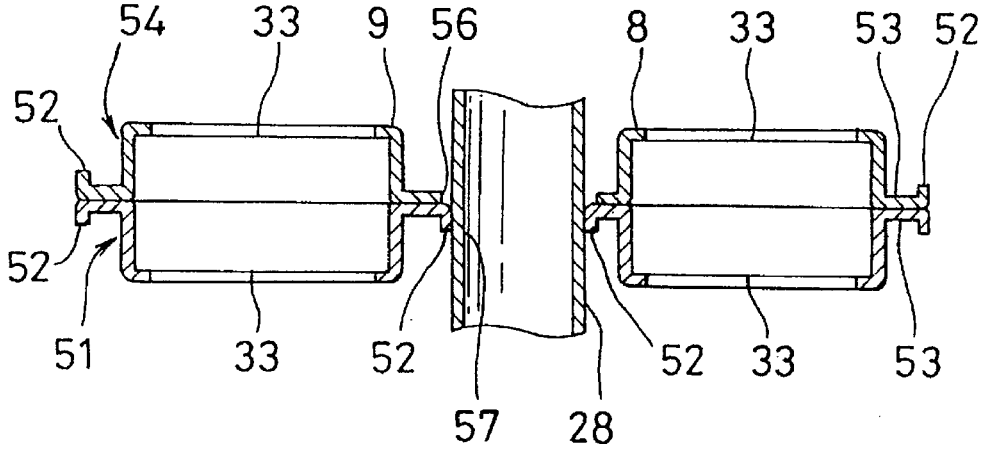
FIG. 15B is its cross section.

The two formed plates 51 and 54, which constitute a tube element 50, shown in FIGS. 15A and 15B, are shown in FIGS. 13 and 14 respectively.

Figure 16:
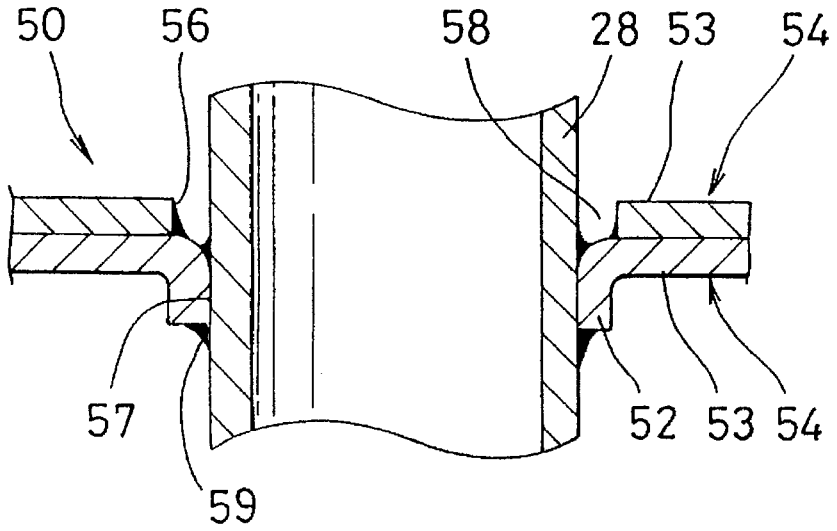
FIG. 16 is a partial enlarged cross section of the state of brazing of the communicating pipe and the indented portions of the tube element shown in FIGS. 15A and 15B.

The formed plate 51 shown in FIG. 13 is a formed plate of the type used in the prior art and is provided with a portion that is bonded with the communicating pipe 28 in its indented portion 57. At the end of a brazing margin 53, provided at the edges of the formed plate 51, a flange 52 is formed. Now, the formed plate 54 shown in FIG. 14 is identical to the formed plate 51 shown in FIG. 13 except for the structure in the vicinity of the indented portion 56. The indented portion 56 of the formed plate 54 is notched in the area that comes in contact with he communicating pipe 28 or, to be more specific, portions of the flange 52 and the brazing margin 53 are notched along the indented portion 57. This allows the tube element 50, constituted by bonding the formed plates 51 and 54 face-to-face, to come in contact with the communicating pipe 28 at the formed plate 51 side while not being in contact with the communicating pipe 28 at the formed plate 54 side. Thus, as shown in FIG. 16, the communicating pipe 28 and the tube element 50 are in contact on one side while they are not in contact with each other on the other side, leaving the clearance 58 exposed to the air. This ensures that water adhering in the clearance 58 will readily evaporate and even if the water becomes frozen, since it expands toward the open side, no excess strength is applied to the bonding areas, eliminating problems such as damage due to freezing and melting of adhered water or corrosion. In addition, since the areas of contact with the communicating pipe 28 for brazing are increased, sufficient strength to hold the communicating pipe 28 is achieved. Note that reference number 59 indicates brazing material.

Figure 17:
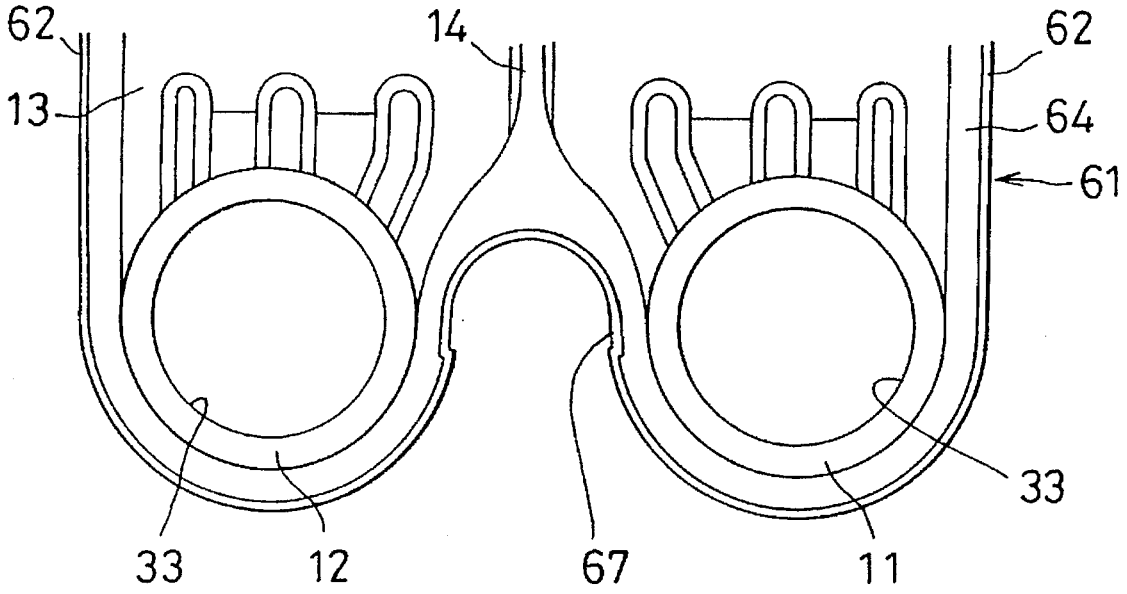
FIG. 17 is a partial enlargement of a formed plate provided with a second means for non-contact.
Figure 18A:
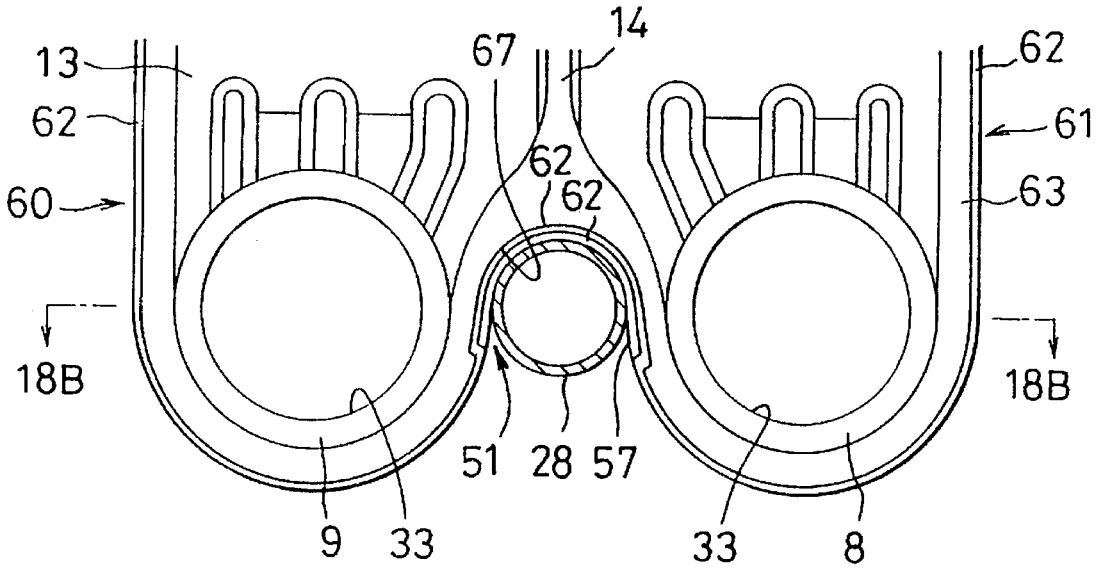
FIG. 18A illustrates the state of contact between a tube element constituted by bonding face-to-face the formed plates shown in FIGS. 13 and 17, and the communicating pipe
Figure 18B:
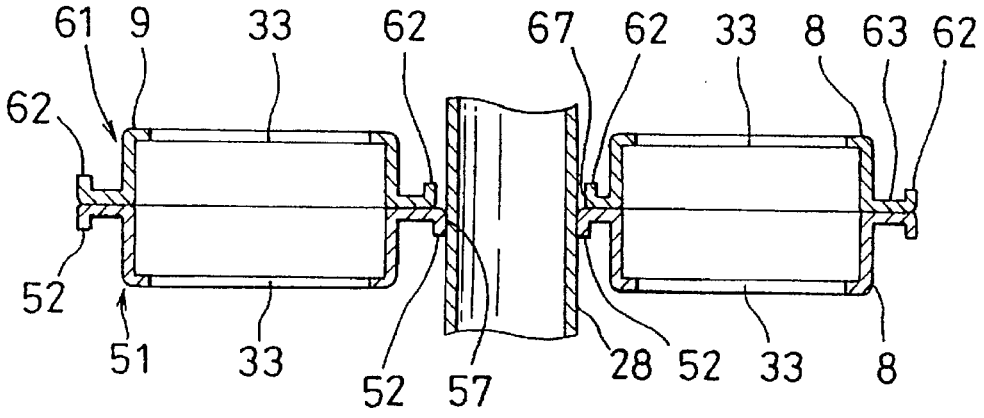
FIG. 18B is its cross section.
Figure 19:
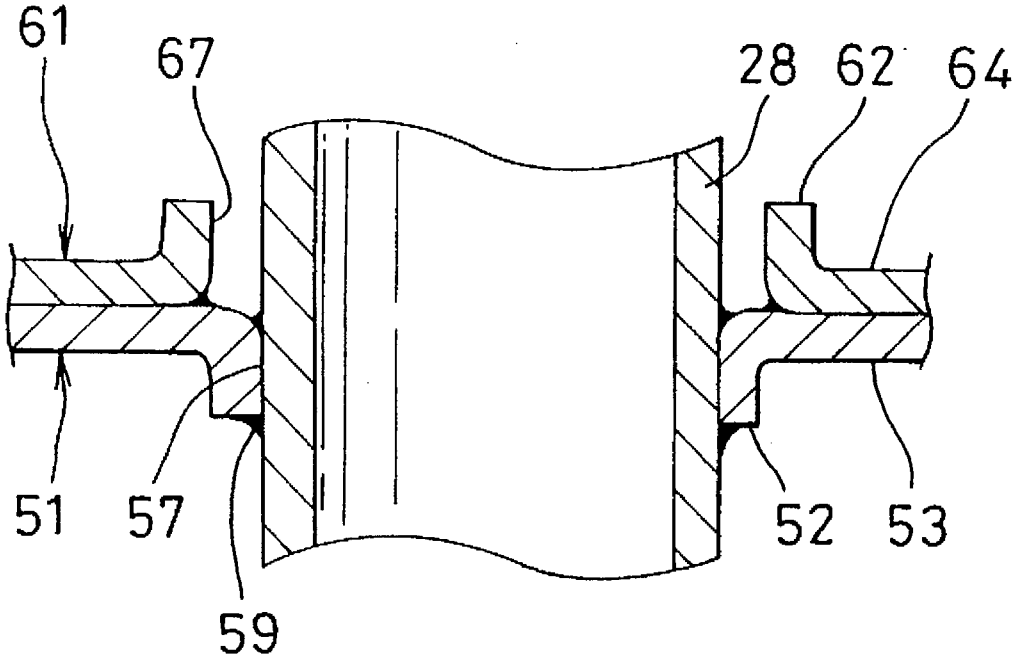
FIG. 19 is a partial enlarged cross section of the state of brazing of the communicating pipe and the indented portions of the tube element shown in FIGS. 18A and 18B.

In another embodiment that is shown in FIG. 17, the indented portion 67 of a formed plate 61 is formed larger than the indented portion 57 of the formed plate 51 by a specific amount. Thus, a tube element 60, constituted by bonding the formed plate 61 and the formed plate 51 face-to-face, is provided with the indented portion 57 of the formed plate 51, which is in contact with the communicating pipe 28 and the indented portion 67 of the formed plate 61, which does not come in contact with the communicating pipe 28, as shown in FIGS. 18A, 18B and 19, achieving advantages similar to those described earlier. In addition, since the flange 67 is formed continuously, the dynamic strength of the formed plate is not reduced. Note that in FIGS. 17, 18A, 18B and 19, reference numbers 62 and 64 indicate a flange and a brazing margin respectively.

Figure 20:
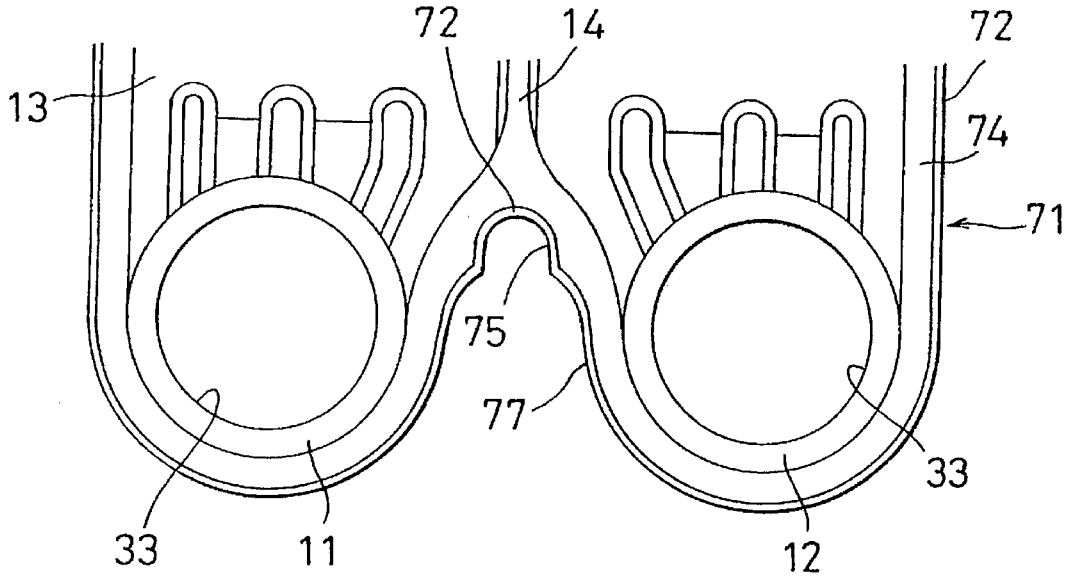
FIG. 20 is a partial enlargement of a formed plate provided with a third means for non-contact.

A formed plate 71 shown in FIG. 20 is another embodiment of the formed plate used on the non-contact side explained above, and is provided with a second indented portion 75 formed in the vicinity of the apex of the indented portion 77 (first indented portion) which comes in contact with the communicating pipe 28 to make this second indented portion 75 a non-contact area. This improves ventilation in the contact area with the communicating pipe 28 so that evaporation of water is promoted. Note that reference numbers 72 and 74 indicate a flange and a brazing margin respectively.

Figure 21:
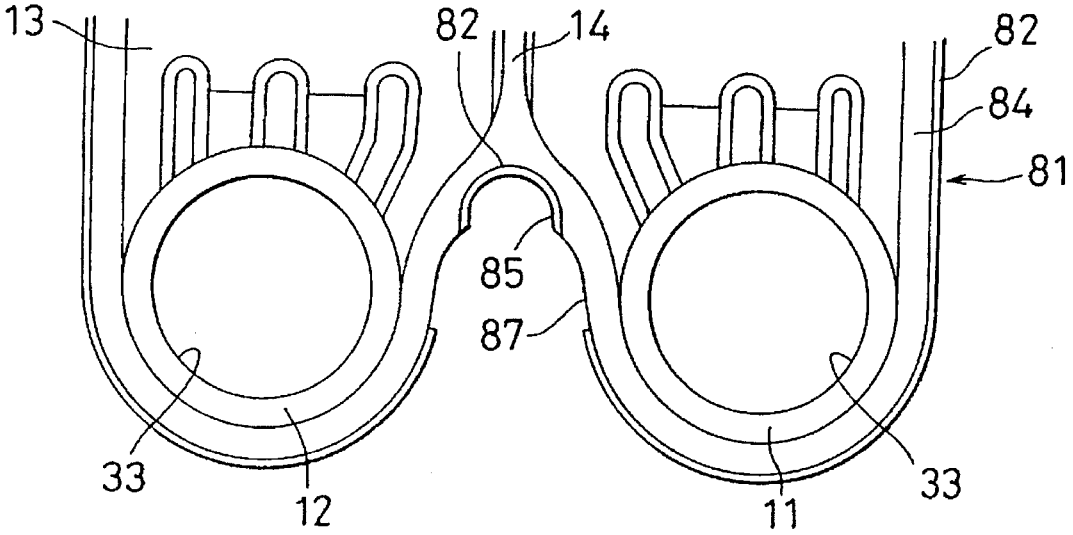
FIG. 21 is a partial enlargement of a formed plate provided with a fourth means for non-contact.

Also a formed plate 81 shown in FIG. 21, is another embodiment of the formed plate used on the non-contact side explained above. In this embodiment, the non-contact area is constituted by notching portions of the flange 82 and the brazing margin 84 in the indented portion 77 which comes in contact with the communicating pipe 28 shown in FIG. 20. Note that reference numbers 82 and 84 indicate a flange and a brazing margin respectively.

Figure 22:
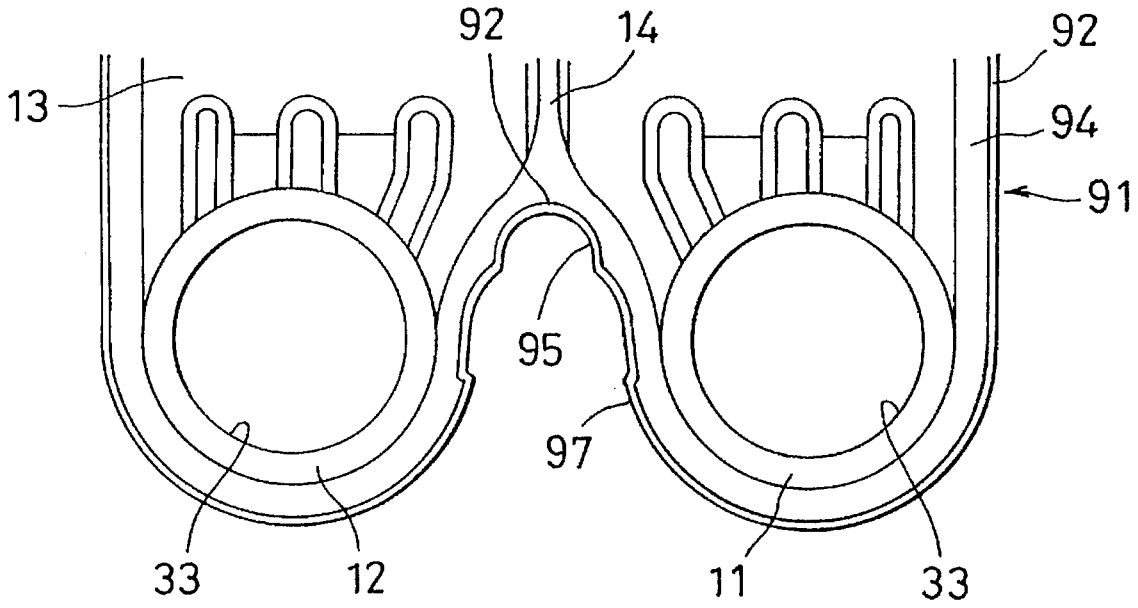
FIG. 22 is a partial enlargement of a formed plate provided with a fifth means for non-contact.

In addition, a formed plate 91 shown in FIG. 22 is formed with the flange 92 provided continuously to achieve advantages similar to those achieved in the formed plate 81 shown in FIG. 21. Note that reference numbers 94, 95 and 97 indicate a brazing margin, a second indented portion and a first indented portion, respectively.

In the embodiments explained above, an indented portion which comes in contact with the communicating pipe is formed in one formed plate while an indented portion which does not come in contact with the communicating pipe is formed in the other formed plate.

Figure 23:
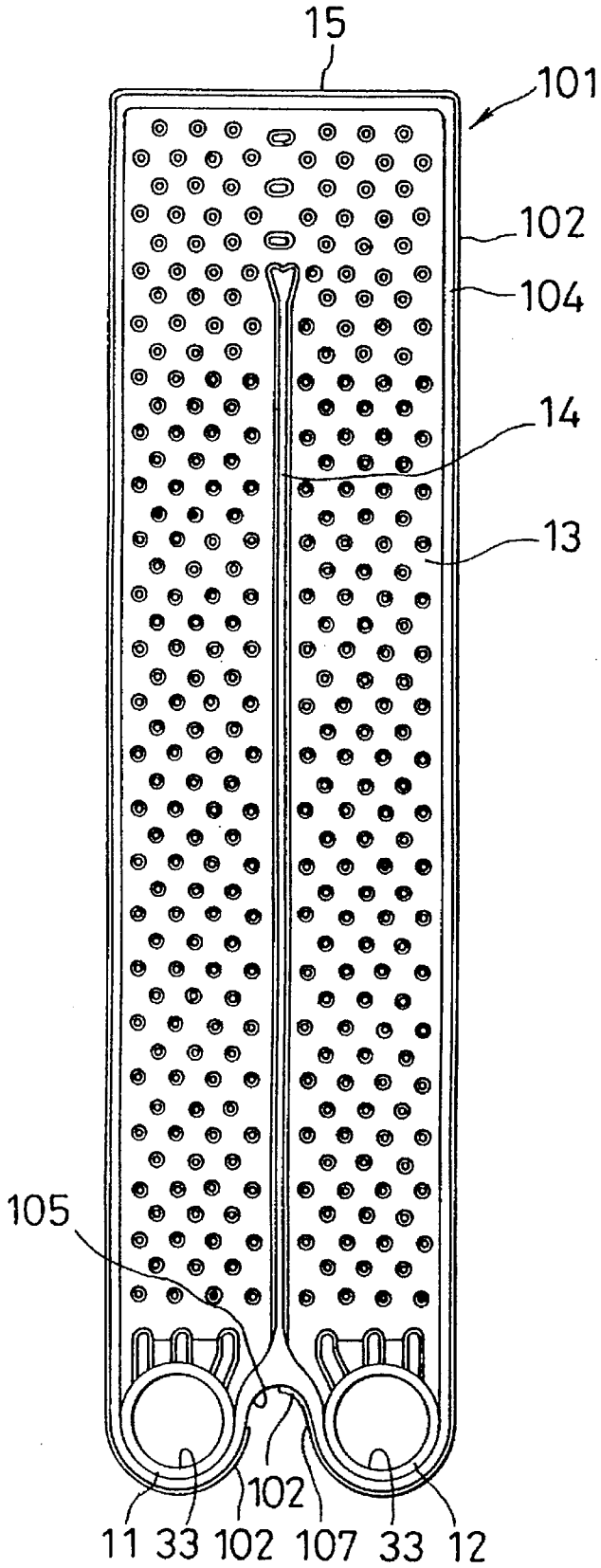
FIG. 23 is a partial enlargement of a formed plate provided with a sixth means for non-contact.
Figure 24A:
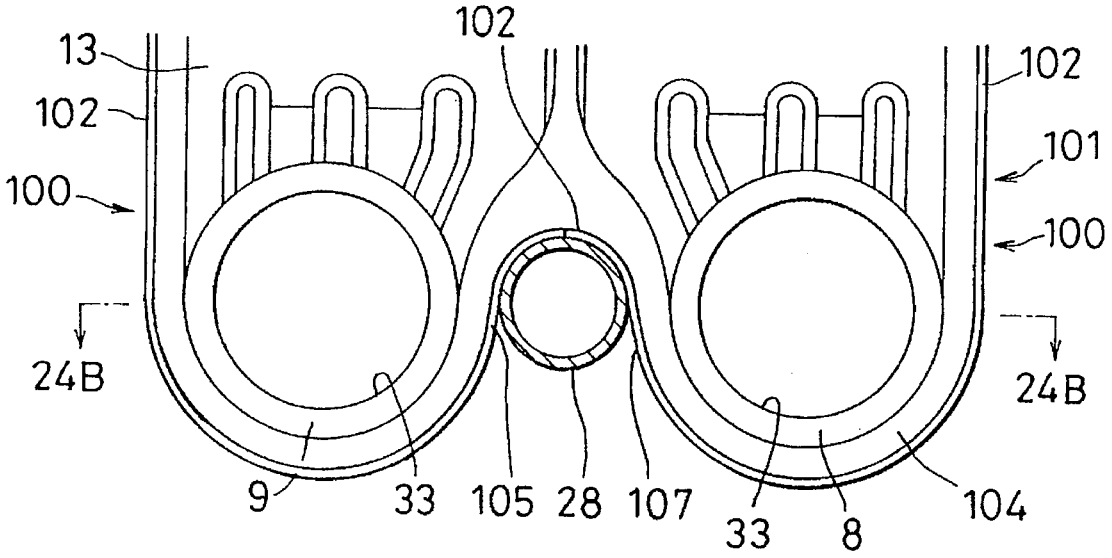
FIG. 24A illustrates the state of contact between the indented portions of the tube element constituted by bonding face-to-face two identical formed plates, one of which is shown in FIG. 23, and the communicating pipe
Figure 24B:
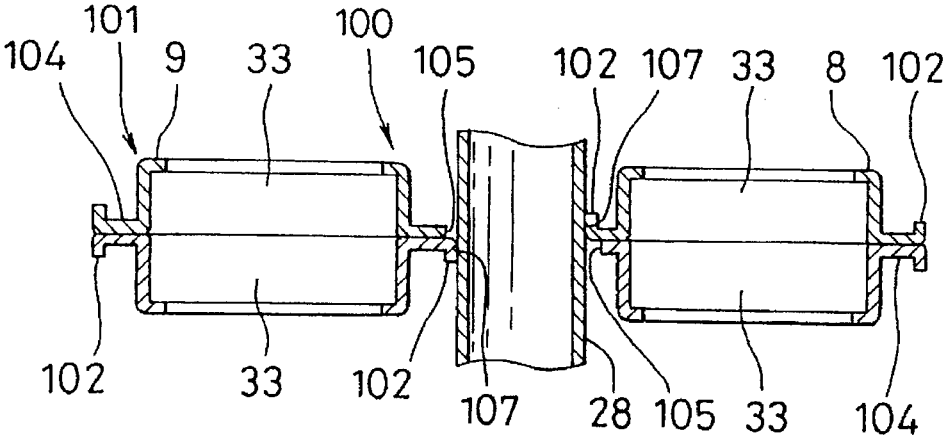
FIG. 24B is its cross section.
Figure 25:
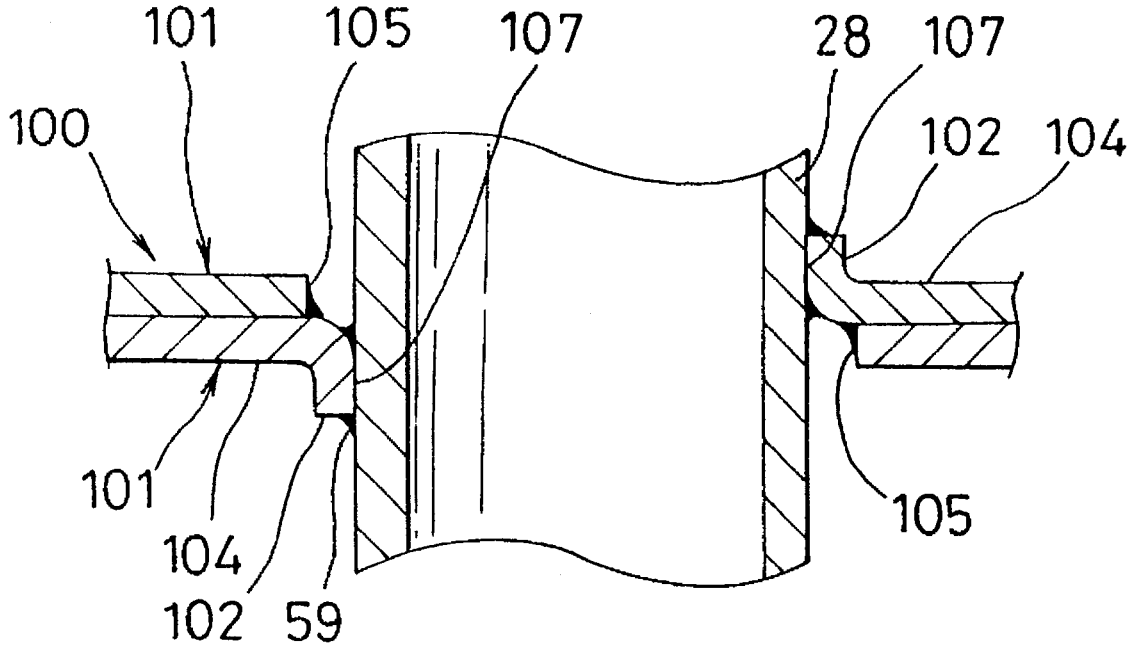
FIG. 25 is a partial enlarged cross section of the state of brazing of the communicating pipe and the indented portion of the tube element shown in FIGS. 24A and 24B.

In contrast, a formed plate 101 shown in FIG. 23 is provided with an indented portion that is divided into two portions i.e., a contact area 107 to which a flange 102 is provided continuously and a non-contact area 105 formed by notching portions of the flange 102 and the brazing margin 104 along the indented portion. The tube element 100, which is constituted by bonding two such formed plates 101 face-to-face, is provided with two half non-contact areas 105 in both directions in the bonding area of the indented portion of the tube element 100 and communicating pipe 28, as shown in FIGS. 24A and 24B. Thus, since the tube element 100 that is provided with the half non-contact areas can be formed using two identical formed plates 101, the number of members is reduced. Since two half clearances that open toward the opposite sides are formed, as shown in FIG. 25, advantages similar to those described earlier are achieved.

Figure 26A:
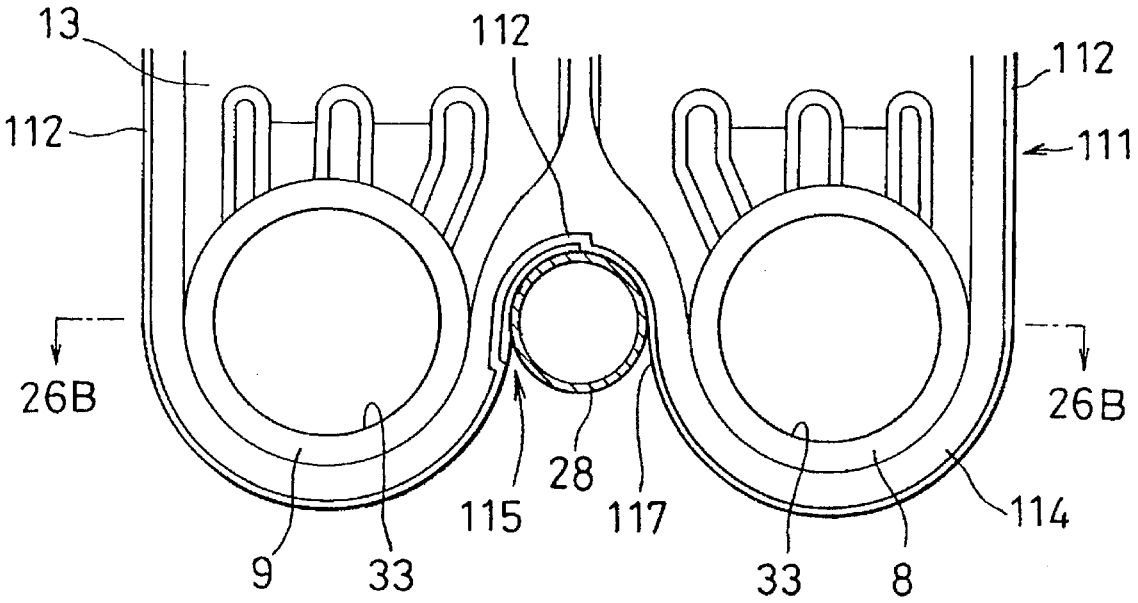
FIG. 26A illustrates the state of contact between the indented portion of the tube element constituted by bonding face-to-face two formed plates, each of which is provided with a seventh means for non-contact, and the communicating pipe
Figure 26B:
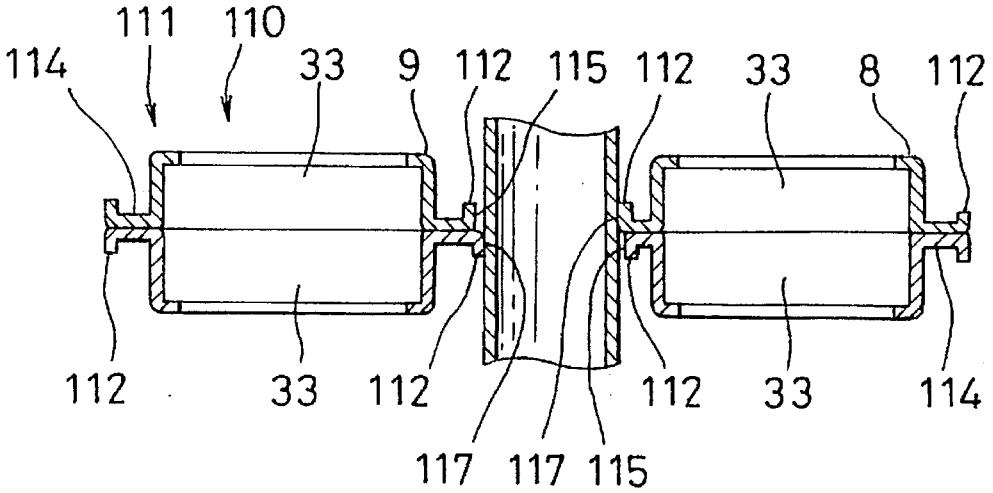
FIG. 26B is its cross section.
Figure 27:
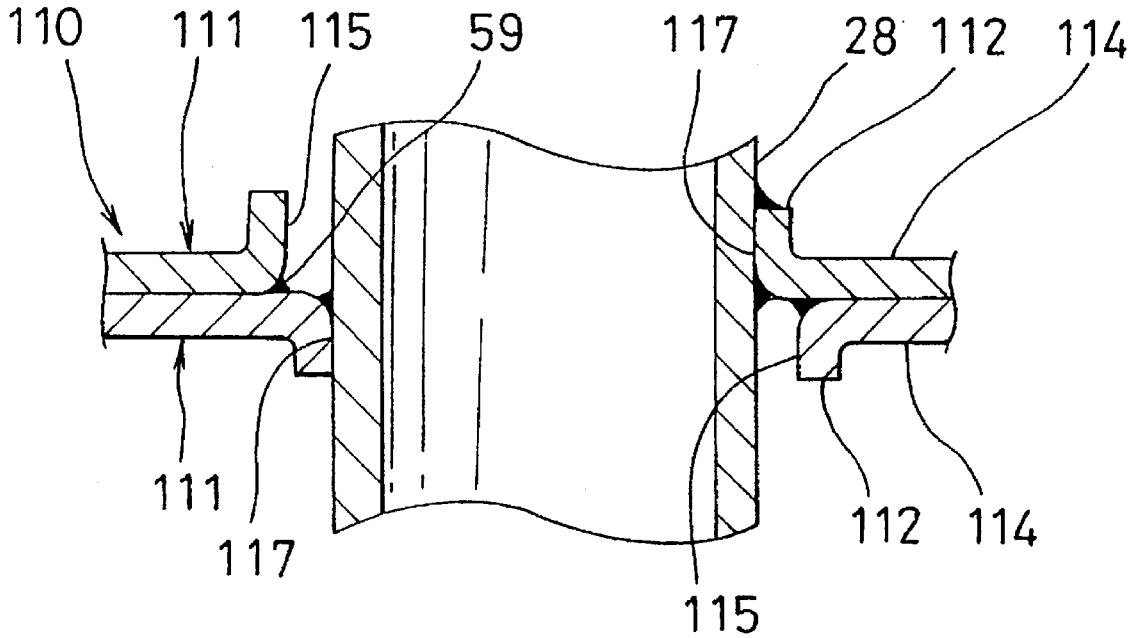
FIG. 27 is a partial enlarged cross section of the state of brazing of the communicating pipe and the indented portion of the tube element shown in FIGS. 26A and 26B.

A formed plate 111 shown in FIGS. 26A, 26B and 27 is provided with an indented portion, half of which is a contact area 117 and the other half of which is the non-contact area 115. The non-contact area 115 is formed by placing a flange 112 into a brazing margin 114 over a specific range along the indented portion. In this manner, since the formed plate 111 is provided with a continuous flange 112, advantages similar to those achieved by the formed plate 101 are achieved without reducing the strength of the formed plate 111.

Figure 28:
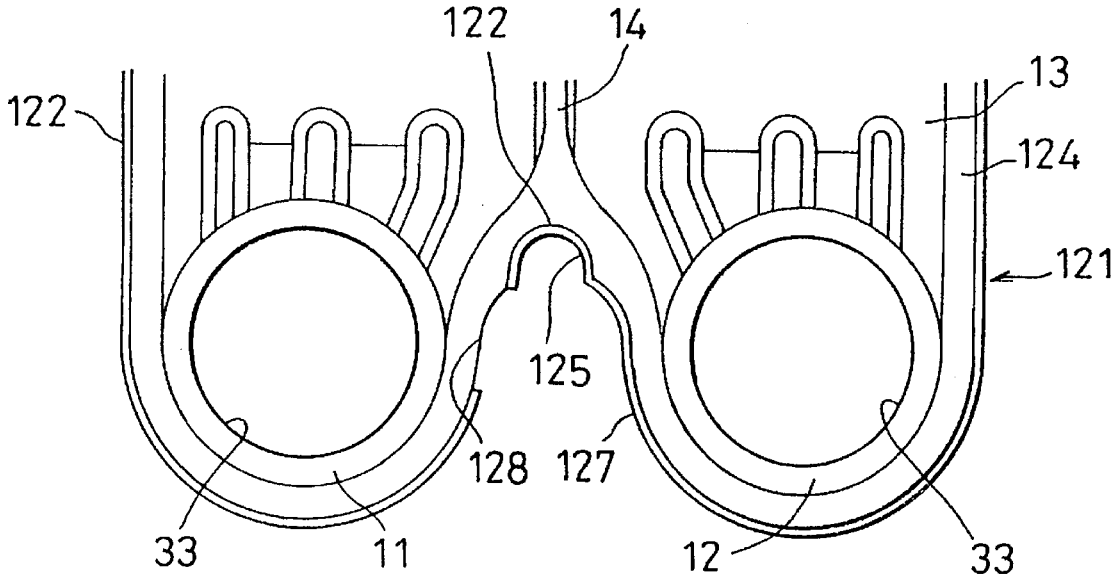
FIG. 28 is a partial enlargement of a formed plate provided with an eighth means for non-contact.

A formed plate 121 shown in FIG. 28 is provided with a contact area 127 and a non-contact area 128 formed by notching a flange 122. In addition, the formed plate 121 is provided with a second indented portion 125 near the apex of the indented portions. This makes it possible to set the non-contact area over a large area and also to maintain the strength of the formed plate at a sufficient level. Note that reference number 122 indicates the flange.

Figure 29:
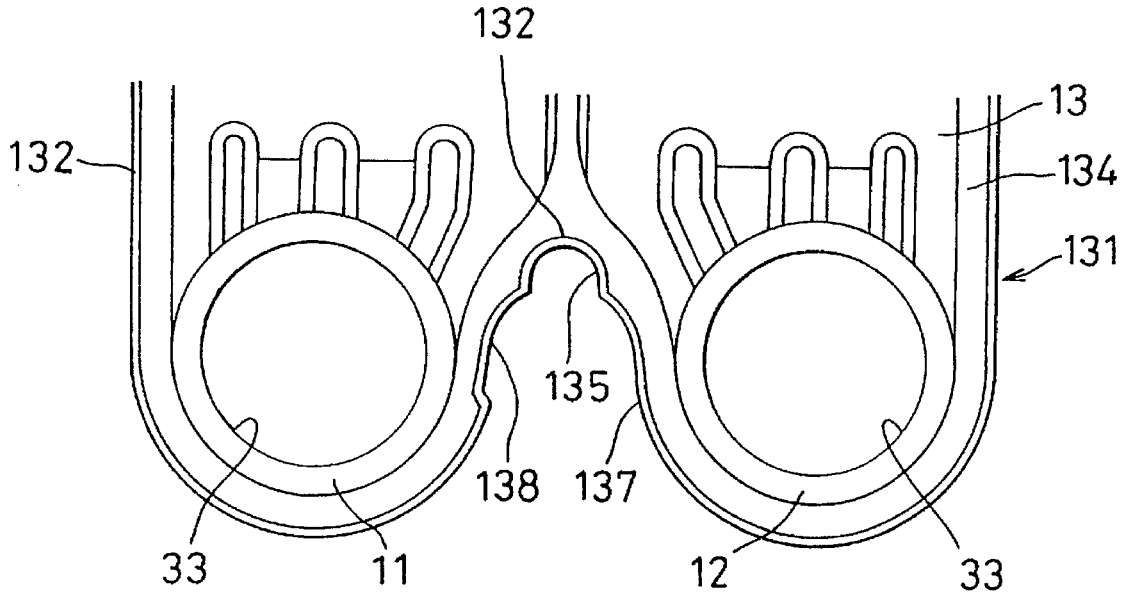
FIG. 29 is a partial enlargement of a formed plate provided with a ninth means for non-contact.
Figure 30:
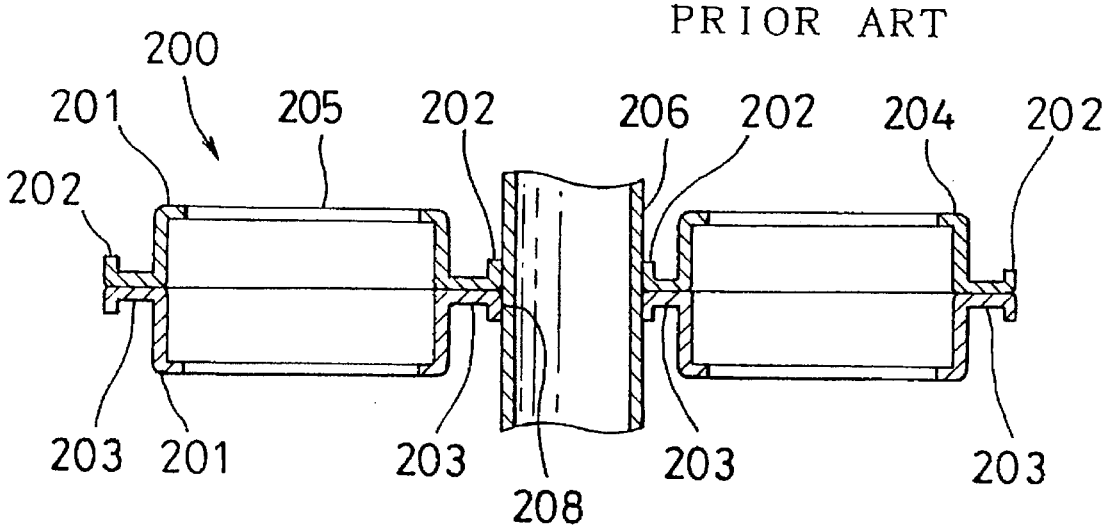
FIG. 30 PRIOR ART
FIG. 30 is an enlargement of the essential part of a heat exchanger of the prior art in the state in which the communicating pipe is provided in a grooved portion of the tube elements, each of which is constituted by bonding two formed plates.
Figure 31:
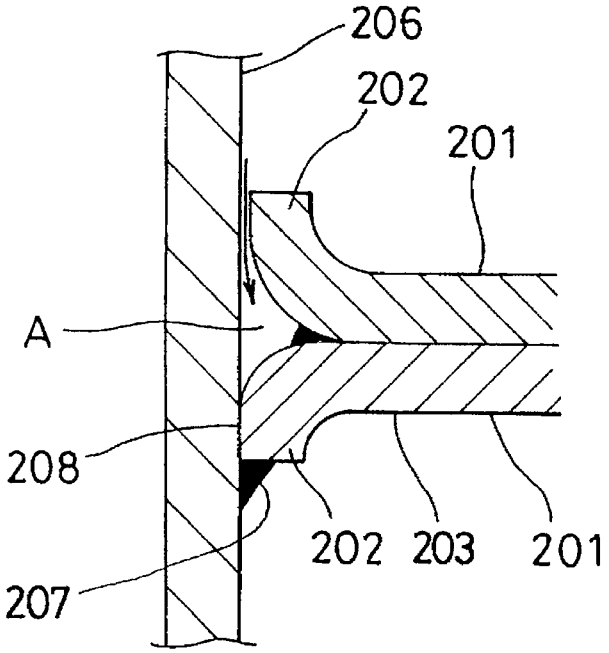
FIG. 31 PRIOR ART
FIG. 31 illustrates a state in which a brazing defect is present in the bonding of the tube element and the communicating pipe shown in FIG. 30.

A formed plate 131 shown in FIG. 29 is provided with a contact area 137 and a non-contact area 138 formed by placing a flange 132 into a brazing margin 134 over a specific range. It is also provided with a second indented portion 135 near the apex of the indented portions. This makes it possible to set the non-contact area over a large area and also to maintain the strength of the formed plate at a sufficient level.

Consequently, since one of the two formed plates constituting the tube element does not come in contact with the communicating pipe, a large opening is formed between the formed plate and the communicating pipe, which prevents water from collecting in the gap between the tube element and the communicating pipe readily. This, in turn, prevents damage to the communicating pipe or corrosion in the communicating pipe due to the water repeating a freezing/melting cycle.

Moreover, since both of the two formed plates constituting the tube element are in contact with the communicating pipe alternately, a large opening is formed between the formed plate and the communicating pipe, which prevents water from collecting in the gap between the tube element and the communicating pipe readily. This, in turn, prevents damage to the communicating pipe of corrosion in the communicating pipe due to the water repeating a freezing/melting cycle.

Furthermore, since the clearance formed by the notch is reliably open to the air, collection of water is prevented.

What is claimed is:

1. A laminated heat exchanger comprising:

a plurality of tube elements laminated together, each of said tube elements comprising a pair of elongated formed plates having respective widths, thicknesses and peripheral edges and being bonded together face-to-face along a thickness direction;

wherein each of said formed plates has first and second longitudinal ends, a pair of distended tank portions formed at said first longitudinal end and disposed opposite one another in a width direction, such that each of said tube elements includes a pair of tanks formed by said distended tank portions;

wherein each of said formed plates has a U-shaped distended passage portion communicating between said pair of distended tank portions, such that each of said tube elements has a U-shaped heat exchanging medium passage communicating between said pair of tanks;

wherein each of said formed plates has an indented portion formed between said pair of distended tank portions, such that each of said tube elements has an indented portion between said pair of tanks;

wherein a communicating portion extends in a width direction from one of said tanks of one of said tube elements toward the indented portion thereof, and said communicating portion is provided with a first insertion hole;

wherein each of said formed plates has a brazing margin formed along said peripheral edge, and a flange provided at said peripheral edge and extending in said thickness direction;

wherein said distended tank portions of a plurality of said formed plates have connecting holes formed therethrough in the thickness direction so as to cause communication between a plurality of said tanks and constitute a plurality of tank groups of contiguous tanks interconnected by said connecting holes;

wherein the distended tank portion of one of said formed plates, in approximately a center of said plurality of laminated tube elements in a direction of lamination, is devoid of a connecting hole so as to block off communication between tanks on opposing sides thereof;

wherein a plurality of fins are provided alternately between said laminated tube elements;

wherein a first end plate is provided at a first end of said plurality of laminated tube elements in a direction of lamination thereof;

wherein a second end plate is provided at a second end of said plurality of laminated tube elements in said direction of lamination thereof, said second end plate having a communicating hole that communicates with one of the tanks of one of said tube elements which is adjacent said second end plate, and a second insertion hole;

wherein an intake/outlet plate is secured to said second end plate and is provided with intake/outlet portions which respectively communicate with said communicating hole and said second insertion hole;

wherein a mounting groove is formed by the indented portions of a plurality of contiguous ones of said tube elements;

wherein a communicating pipe is mounted in said mounting groove and connects said first insertion hole in said communicating portion with said second insertion hole in said second end plate; and wherein a non-contact means is provided, in said indented portion of each of said formed plates of each of said tube elements having the indented portions which form said mounting groove, for ensuring that said communicating pipe does not come into contact against said indented portions in which said non-contact means is provided.

2. A laminated heat exchanger according to claim 1, wherein said non-contact means is constituted by setting widths of said indented portions forming said communicating groove larger than a diameter of said communicating pipe.

3. A laminated heat exchanger according to claim 2, wherein an arc-shaped holding portion is formed and extends out from a circumferential edge of said first insertion hole toward said second insertion hole to hold one end of said communicating pipe.

4. A laminated heat exchanger according to claim 2, wherein an arc-shaped holding portion is formed and extends out from a circumferential edge of said second insertion hole toward said first insertion hole to hold one end of said communicating pipe.

5. A laminated heat exchanger according to claim 2, wherein holding portions are formed and extend toward each other from circumferential edges of said first insertion hole and said second insertion hole, respectively, to hold opposing ends of said communicating pipe.

6. A laminated heat exchanger according to claim 5, wherein a further holding portion for holding said communicating pipe is provided in the indented portion of the one of said tube elements that is adjacent to said second end plate.

7. A laminated heat exchanger according to claim 2, wherein the indented portion of the one of said tube elements that is adjacent to said second end plate is made to be in contact with one end of said communicating pipe.

8. A laminated heat exchanger comprising:

a plurality of tube elements laminated together, each of said tube elements comprising a pair of elongated formed plates having respective widths, thicknesses and peripheral edges and being bonded together face-to-face along a thickness direction;

wherein each of said formed plates has first and second longitudinal ends, a pair of distended tank portions formed at said first longitudinal end and disposed opposite one another in a width direction, such that each of said tube elements includes a pair of tanks formed by said distended tank portions;

wherein each of said formed plates has a U-shaped distended passage portion communicating between said pair of distended tank portions, such that each of said tube elements has a U-shaped heat exchanging medium passage communicating between said pair of tanks;

wherein each of said formed plates has an indented portion formed between said pair of distended tank portions, such that each of said tube elements has an indented portion between said pair of tanks;

wherein a communicating portion extends in a width direction from one of said tanks of one of said tube elements toward the indented portion thereof, and said communicating portion is provided with a first insertion hole;

wherein each of said formed plates has a brazing margin formed along said peripheral edge, and a flange provided at said peripheral edge and extending in said thickness direction;

wherein said distended tank portions of a plurality of said formed plates have connecting holes formed therethrough in the thickness direction so as to cause communication between a plurality of said tanks and constitute a plurality of tank groups of contiguous tanks interconnected by said connecting holes;

wherein the distended tank portion of one of said formed plates, in approximately a center of said plurality of laminated tube elements in a direction of lamination, is devoid of a connecting hole so as to block off communication between tanks on opposing sides thereof;

wherein a plurality of fins are provided alternately between said laminated tube elements;

wherein a first end plate is provided at a first end of said plurality of laminated tube elements in a direction of lamination thereof;

wherein a second end plate is provided at a second end of said plurality of laminated tube elements in said direction of lamination thereof, said second end plate having a communicating hole that communicates with one of the tanks of one of said tube elements which is adjacent said second end plate, and a second insertion hole;

wherein an intake/outlet plate is secured to said second end plate and is provided with intake/outlet portions which respectively communicate with said communicating hole and said second insertion hole;

wherein a mounting groove is formed by the indented portions of a plurality of contiguous ones of said tube elements;

wherein a communicating pipe is mounted in said mounting groove and connects said first insertion hole in said communicating portion with said second insertion hole in said second end plate; and wherein a non-contact means is provided, in said indented portion of at least one of said formed plates of each of said tube elements having the indented portions which form said mounting groove, for ensuring that said communicating pipe does not come into contact against said indented portion in which said non-contact means is provided.

9. A laminated heat exchanger according to claim 8, wherein for each formed plate having said non-contact means, said non-contact means is constituted by:

cutting off said flange and said brazing margin over a specific range along said indented portion of said formed plate.

10. A laminated heat exchanger according to claim 8, wherein for each tube element having said non-contact means, said non-contact means is constituted by:

forming said indented portion of one of said formed plates larger than the indented portion of the other of said formed plates, said other of said formed plates being in contact with said communicating pipe.

11. A laminated heat exchanger according to claim 8, wherein for each tube element having said non-contact means, said non-contact means is constituted with:

a non-contact area formed by indenting a portion of said indented portion of one of said formed plates in a longitudinal direction of said formed plate.

12. A laminated heat exchanger according to claim 11, wherein for each formed plate having said non-contact means, said non-contact means is constituted by:

cutting off said flange in said indented portion of said formed plate at an area other than said non-contact area.

13. A laminated heat exchanger according to claim 8, wherein for each tube element having said non-contact means, said non-contact means is constituted with:

a first non-contact area formed by indenting a portion of said indented portion of one of said formed plates in a longitudinal direction of said formed plate, and a second non-contact area provided by enlarging an area of said indented portion other than said first non-contact area relative to contact areas of said indented portion.

14. A laminated heat exchanger according to claim 8, wherein for each formed plate having said non-contact means, said non-contact means is constituted by:

cutting off portions of said flange and said brazing margin which are positioned over approximately half of an area surrounding said indented portion of said formed plate along said indented portion.

15. A laminated heat exchanger according to claim 8, wherein for each formed plate having said non-contact means, said non-contact means is constituted by:

enlarging approximately half of an area surrounding said indented portion of said formed plate relative to a remainder of said area surrounding said indented portion.

16. A laminated heat exchanger according to claim 8, wherein for each tube element having said non-contact means, said non-contact means is constituted by:

providing a non-contact area formed by indenting a portion of the indented portion of one of said formed plates in a longitudinal direction thereof, and cutting off portions of said flange and said brazing margin over approximately half of an area of said indented portion that is other than said non-contact area.

17. A laminated heat exchanger according to claim 8, wherein for each tube element having said non-contact means, said non-contact means is constituted by:

providing a non-contact area by indenting a portion of said indented portion of one of said formed plates in a longitudinal direction thereof and enlarging approximately half of an area of said indented portion other than said non-contact area relative to a remainder of said area of said indented portion other than said non-contact area.

18. A laminated heat exchanger comprising:

a plurality of tube elements laminated together, each of said tube elements comprising a pair of elongated formed plates having respective widths, thicknesses and peripheral edges and being bonded together face-to-face along a thickness direction;

wherein each of said formed plates has first and second longitudinal ends, a pair of distended tank portions formed at said first longitudinal end and disposed opposite one another in a width direction, such that each of said tube elements includes a pair of tanks formed by said distended tank portions;

wherein each of said formed plates has a U-shaped distended passage portion communicating between said pair of distended tank portions, such that each of said tube elements has a U-shaped heat exchanging medium passage communicating between said pair of tanks;

wherein each of said formed plates has an indented portion formed between said pair of distended tank portions, such that each of said tube elements has an indented portion between said pair of tanks;

wherein a communicating portion extends in a width direction from one of said tanks of one of said tube elements toward the indented portion thereof, and said communicating portion is provided with a first insertion hole;

wherein each of said formed plates has a brazing margin formed along said peripheral edge, and a flange provided at said peripheral edge and extending in said thickness direction;

wherein said distended tank portions of a plurality of said formed plates have connecting holes formed therethrough in the thickness direction so as to cause communication between a plurality of said tanks and constitute a plurality of tank groups of contiguous tanks interconnected by said connecting holes;

wherein the distended tank portion of one of said formed plates, in approximately a center of said plurality of laminated tube elements in a direction of lamination, is devoid of a connecting hole so as to block off communication between tanks on opposing sides thereof;

wherein a plurality of fins are provided alternately between said laminated tube elements;

wherein a first end plate is provided at a first end of said plurality of laminated tube elements in a direction of lamination thereof;

wherein a second end plate is provided at a second end of said plurality of laminated tube elements in said direction of lamination thereof, said second end plate having a communicating hole that communicates with one of the tanks of one of said tube elements which is adjacent said second end plate, and a second insertion hole;

wherein an intake/outlet plate is secured to said second end plate and is provided with intake/outlet portions which respectively communicate with said communicating hole and said second insertion hole;

wherein a mounting groove is formed by the indented portions of a plurality of contiguous ones of said tube elements;

wherein a communicating pipe is mounted in said mounting groove and connects said first insertion hole in said communicating portion with said second insertion hole in said second end plate; and wherein a non-contact means is provided, in said indented portion of at least one of said formed plates of at least one of said tube elements having the indented portions which form said mounting groove, for ensuring that said communicating pipe does not come into contact against said indented portion in which said non-contact means is provided.

* * * * *